US011393436B2

(12) United States Patent
Silverman et al.

(10) Patent No.: US 11,393,436 B2
(45) Date of Patent: Jul. 19, 2022

(54) HARNESS FOR A VIOLIN OR VIOLA

(71) Applicant: Silverman Musical Enterprises, LLC, Nashville, TN (US)

(72) Inventors: Tracy Silverman, Nashville, TN (US); Scott Hill, Huntsville, AL (US)

(73) Assignee: Silverman Musical Enterprises, LLC, Nashville, TN (US)

( * ) Notice: Subject to any disclaimer, the term of this patent is extended or adjusted under 35 U.S.C. 154(b) by 0 days.

(21) Appl. No.: 17/162,349

(22) Filed: Jan. 29, 2021

(65) Prior Publication Data

US 2021/0158788 A1 May 27, 2021

Related U.S. Application Data

(63) Continuation-in-part of application No. 16/737,120, filed on Jan. 8, 2020, now abandoned, which is a continuation-in-part of application No. 16/114,893, filed on Aug. 28, 2018, now abandoned, which is a continuation of application No. 15/489,860, filed on Apr. 18, 2017, now Pat. No. 10,089,970.

(60) Provisional application No. 62/324,101, filed on Apr. 18, 2016.

(51) Int. Cl.
*G10D 1/02* (2006.01)
*G10G 5/00* (2006.01)

(52) U.S. Cl.
CPC ..... *G10G 5/005* (2013.01); *G10D 1/02* (2013.01)

(58) Field of Classification Search
CPC ..... G10G 5/005; G10D 1/02; G10D 3/18; G10D 1/00; G10D 3/00
See application file for complete search history.

(56) References Cited

U.S. PATENT DOCUMENTS

| | | | |
|---|---|---|---|
| 2,697,374 A | 12/1954 | Malvin | |
| 3,690,211 A | 9/1972 | Long | |
| 4,251,016 A | 2/1981 | O'Rafferty | |
| 10,089,970 B2 | 10/2018 | Silverman | |
| 2016/0300553 A1* | 10/2016 | de Chadenedes ..... | G10G 5/005 |

OTHER PUBLICATIONS

Wood Instruments How to Wear the Viper as Demonstrated by its Inventor Electric Violinist Mark Wood, https://youtu.be/Dk2EZjfUSIs [youtu.be].

* cited by examiner

*Primary Examiner* — Kimberly R Lockett
(74) *Attorney, Agent, or Firm* — Greenspoon Marder LLP; Justin F. McNaughton

(57) ABSTRACT

An ergonomic harness for chin-free support of violins and violas that incorporates clamps for a stringed instrument, a support arm, and a stabilizer. A neck strap secures the harness system around the neck of a person playing a stringed instrument and holds the harness in place against the person's shoulder and/or chest. A support arm supports the weight of the instrument and a stabilizer prevents the support arm from rotating.

17 Claims, 24 Drawing Sheets

HARNESS FOR A VIOLIN OR VIOLA

CROSS REFERENCE TO RELATED APPLICATIONS

This application is a continuation-in-part of U.S. patent application Ser. No. 16/737,120 filed Jan. 8, 2020, which is a continuation-in-part of U.S. patent application Ser. No. 16/114,893, filed Aug. 28, 2018, which is a continuation of U.S. patent application Ser. No. 15/489,860, filed Apr. 18, 2017, which claims the benefit of priority from U.S. Provisional Patent Application No. 62/324,101, filed Apr. 18, 2016, the contents of all incorporated herein in their entirety by reference thereto.

BACKGROUND OF THE INVENTION

Violinists (and especially violists) can incur injury and pain to their upper back and neck regions due to the common methods of supporting an instrument using the chin and shoulder. Typically, the left shoulder is elevated to support the body of the instrument and can be held in this elevated position for extended periods of time. For example, when a musical piece is technically difficult, a musician may generate substantial movement of the upper shoulder positions while performing. Providing consistent support for the instrument under such conditions, the musician often must apply excessive pressure between the chin and shoulder to pin the instrument in place. As a result, many musicians incur significant expense on chiropractic care and physical therapy to provide relief from discomforts involving the spine, nerves and muscles of the neck, shoulder and upper back. In addition to the ergonomics of instrument support, many musicians must cease supporting and performing their instrument from time to time to allow their chin to be moved during singing. What is needed in the art is a neck strap for a violin or viola that provides both an ergonomically improved support for the instrument during performing yet does not involve the use of the shoulders, neck and head. Such a strap would also allow a musician to play the instrument and sing simultaneously, if so desired.

Existing straps for acoustic violins generally cannot provide simultaneous instrument support and allow maximum freedom of movement. One type of strap employs a belt of fabric placed around the neck and under the arm, like a standard guitar strap. This type strap is often secured to the instrument by threading it under the tailpiece of the violin, which sets the weight of the instrument on the tail piece and end pin. This type of design is not a structurally sound configuration for a violin.

What is needed in the art is a harness or support attached to the instrument that protects it from scratching or causing structural damage to the instrument. Such a harness or support can be connected to a neck strap so that the device would form a complete system for supporting the instrument during performances. Such a harness system does not pass under the musician's arm, nor would it bolt into the instrument, nor require any modification to the instrument.

This novel harness system should further be lightweight, strong, comfortable, aesthetically simple and beautiful. The harness system should also be as small as possible and collapsible to fit in a standard instrument case. The harness system should also attach quickly and securely to the instrument while not affecting the acoustics of the instrument and not requiring any physical modification to the instrument. Finally, the harness system should be adjustable and be available to musicians at an affordable price. In one embodiment, the harness system comes in two basic sizes, one for violin and a slightly larger size for viola.

SUMMARY OF THE INVENTION

The device presented is a combination of an adjustable neck strap that clips onto a lightweight harness. The device clamps to the instrument around the instrument's C-bouts and is adaptable to most all instrument shapes and sizes. In the one embodiment, the harness clasps a violin or viola symmetrically at two tabs in the C-bouts and two tabs along the bottom body of the instrument. In one embodiment, the device clamps to opposite sides of the lower C-bouts. In one embodiment, the device has a support arm and a stabilizer to hold and support the instrument without the user's chin. The points of contact between the device and the surface features of the instrument are fitted with a malleable material that compresses slightly. In another embodiment, an adjustable, padded chest or shoulder support arm is attached to the device for additional support options.

DETAILED DESCRIPTION

Figure 1:
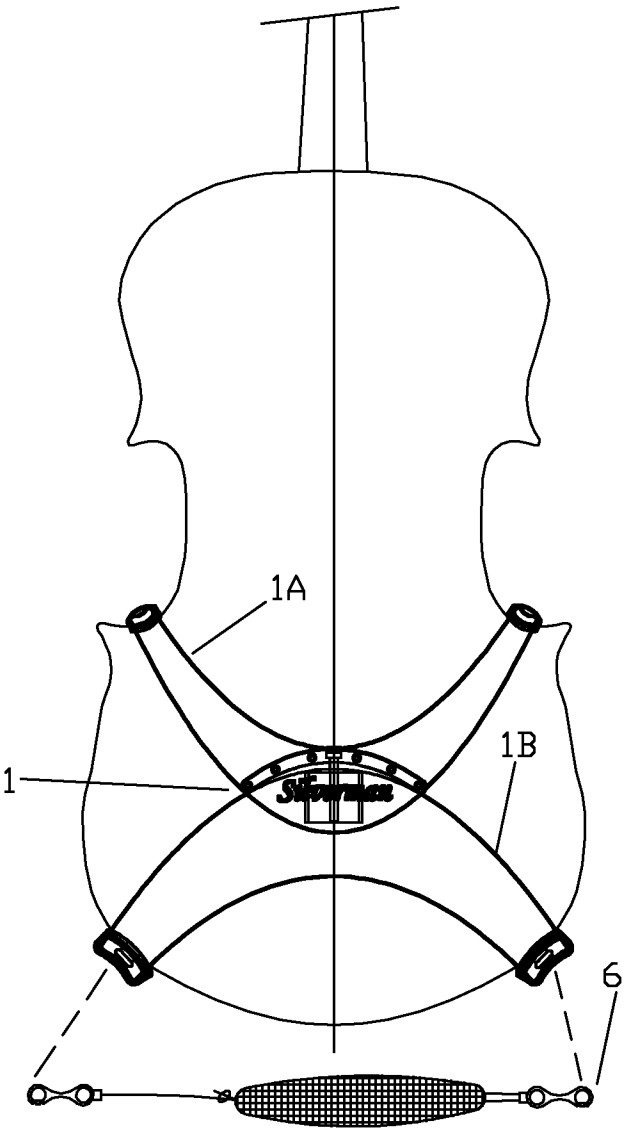
FIG. 1 is a plan view of the rear face of a violin body showing the harness system of the present invention. For reference, in the drawings and in the detailed description to follow, the term "upper" means closer to the C-bouts and the term "lower" means closer to the bottom of the violin.

Referring to FIG. 1, one embodiment of the harness system is comprised of a standard neck strap 6 and an instrument harness 1. The instrument harness is further comprised of two partly-overlapping, rigid harness plates, 1A and 1B. The upper harness plate, 1A engages the instrument in at least two points on opposite sides of the instrument at each of the lower curves of the C-bouts (a C-bout is the C-shaped curve in the middle of the sides of a violin which forms its "waist"). The lower harness plate attaches at two points on opposite sides of the instrument at each of the curves that converge to the bottom of the instrument and closest to the musician's upper torso when the instrument is played.

Figure 6:
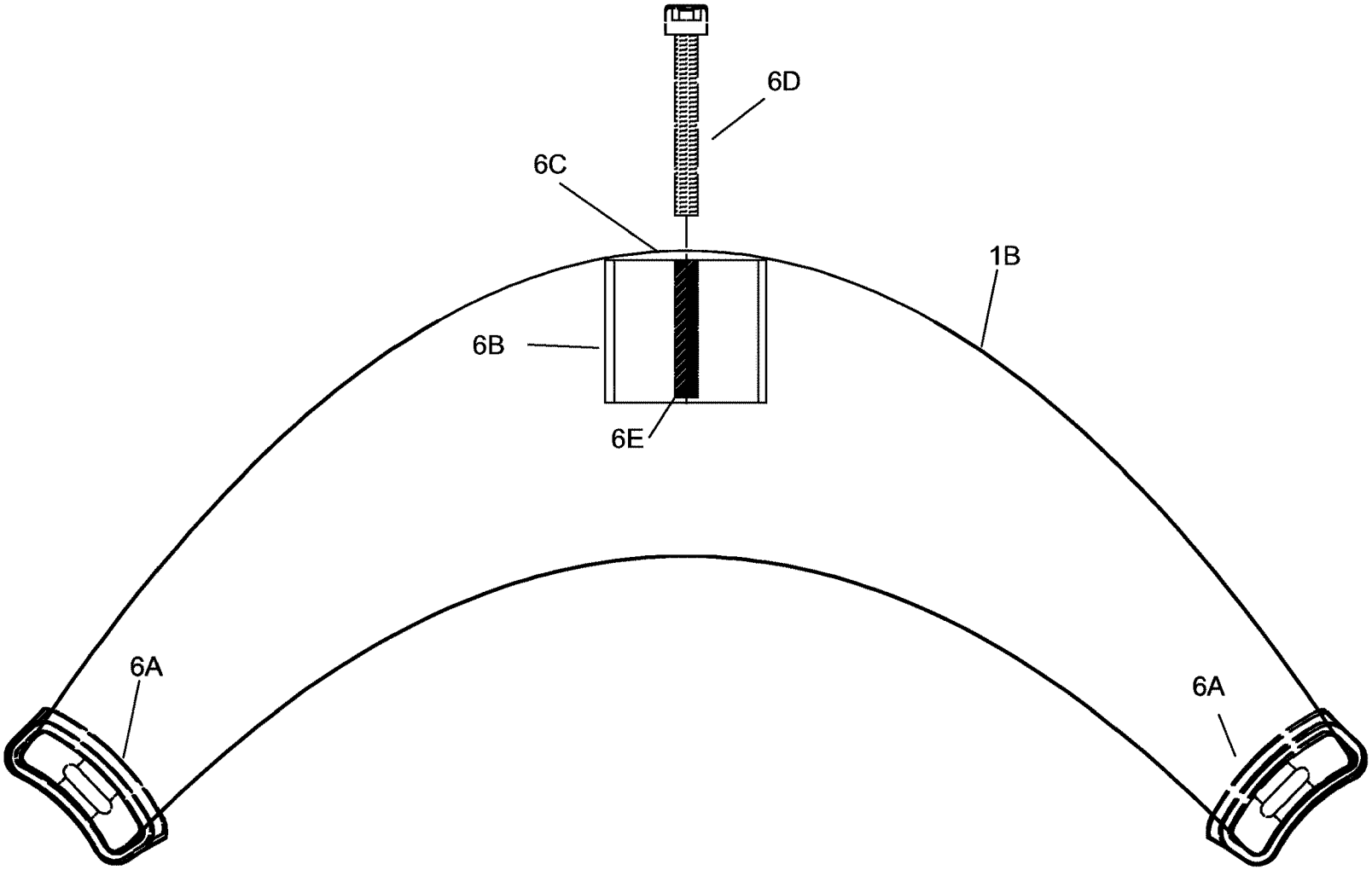
FIG. 6 is a top view of the lower harness plate and shows the threaded guide block, and the guide block fastener.

In continued reference to FIG. 1, and in more detail in FIG. 6, the neck strap 6 can be a short, adjustable, padded neck strap similar type to those used with a saxophone. In the embodiment of FIG. 1, the strap attaches to the harness at either of the lower plate contact points. In one embodiment, the strap is fitted on either end with standard swivel bolt snap hooks that can connect to the lower plate contact points to allow the strap to rotate without applying torque to the strap.

Figure 2:
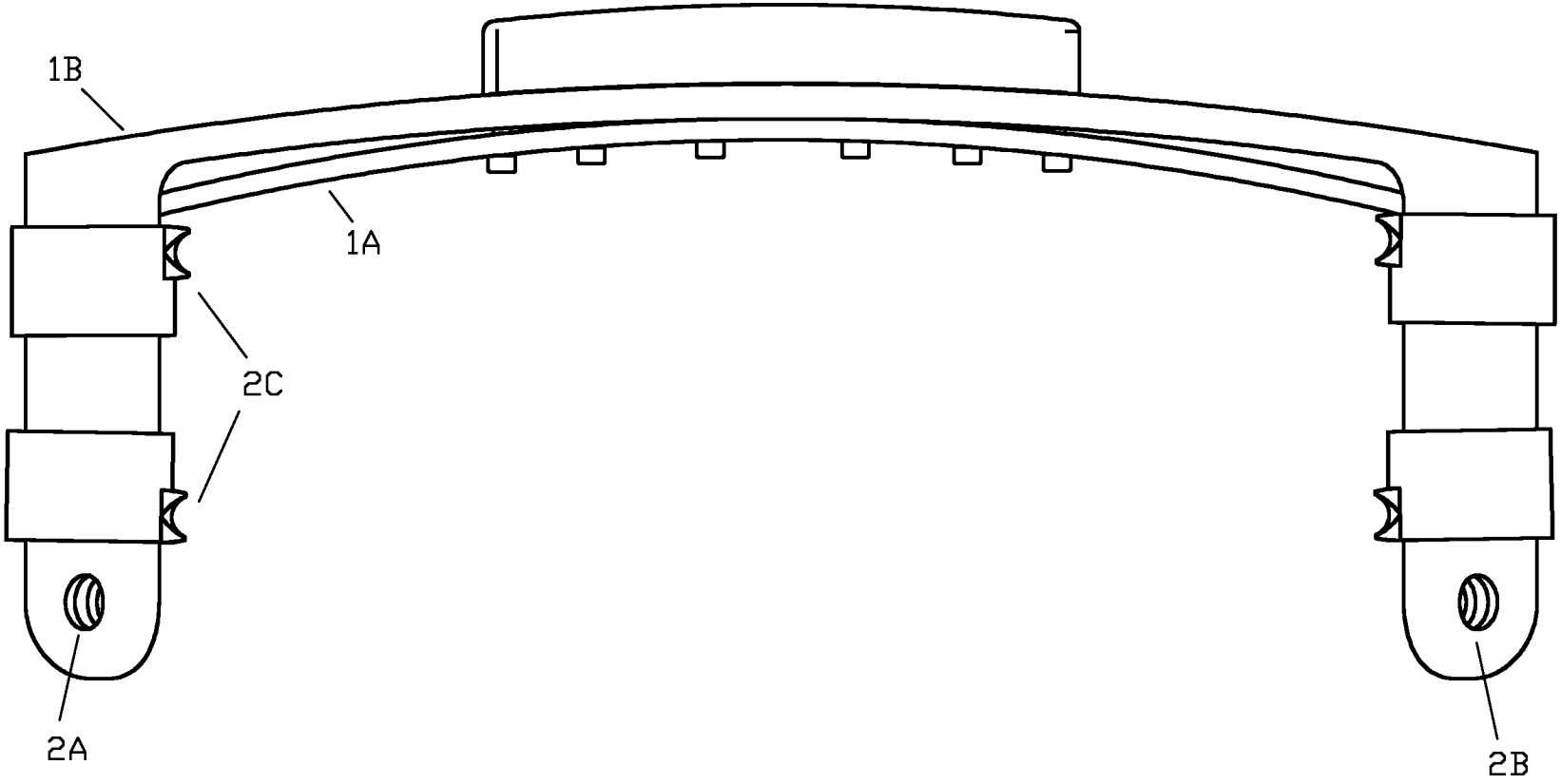
FIG. 2 is a side view of the harness system positioned in FIG. 1 with the lower rib tabs in the foreground and the upper rib tabs in the background hidden behind.

Referring to the embodiment of FIG. 2, the upper and lower harness plates 1A and 1B can be fabricated from a thin frame made of carbon fiber, plastic, metal or other strong, lightweight material which securely anchors to the back of the instrument at the points of contact. The function of the harness is to securely attach to the instrument in a minimum of four symmetrically distributed attachment points and to provide at least two attachment points for the neck strap.

In continued reference to FIG. 2, at least two rib tabs 2A and 2B extend outward from the lower harness plate 1B over the top of the instrument and serve as attachment points for the strap. In one embodiment, the harness plates are substantially planar, but in the embodiment of FIG. 2, the harness plates can be slightly arched to match the curved profile of the back of an instrument. In one embodiment, the harness is low profile matching the curve of an instrument so that it can remain on the instrument while in the case.

In continued reference to of FIG. 2, the rib tabs of the bottom harness plate extend away from the lower plate at a right angle to the centerline of the plates. In one embodiment, the rib tabs include one or more soft saddles 2C that engage the instrument edges securely without damaging the instrument when the harness is tightened or attached. These soft saddles clasp the extended edging of the front and back surfaces of the instrument, which is common to many violin designs. However, other soft saddle shapes and positions could be added or even customized to accommodate other instrument shapes. In one embodiment, the soft saddles are formed from flexible reinforced silicon or neoprene rubber and are readily stretched over the rib tabs and positioned as the musician desires to optimally contact and stabilize the harness to their particular instrument shape. When the stretching is released, the soft saddle grips the rib tab with sufficient force to be relatively immovable when the harness is tightened in place about the instrument. In the one embodiment, the rib tabs of the lower plate have two soft saddle contact points that engage the extended front and rear edging common to many types of violins. The rib tabs of the C-bout contact points of the upper plate have at least one soft saddle that engages the extended edge of the rear face of the instrument. On the ends of the rib tabs, holes 2A and 2B are provided for attaching a neck strap. The neck strap can attach to the rib tabs using a swivel bolt snap hook, which also can be coated with a material that reduces any undesired sounds caused by the vibration of the instrument. Also, in one embodiment, the profile of the rib tabs are contoured to match the surface shape of the instrument at each contact point. In another embodiment, the profile of the rib tabs can be rounded opposite the contour of the instrument so they will easily receive different angles and curves of varying instruments by minimizing the contact points. Contouring the rib tab contact points to a rounded shape with a curvature opposite the curvature of the instrument is generally better for preventing damage to the instrument and allows for reduced thickness of the soft saddles, which would have to fill in the spacing between the rib tab and instrument if the rib tab were flat or non-contoured.

Figure 3:
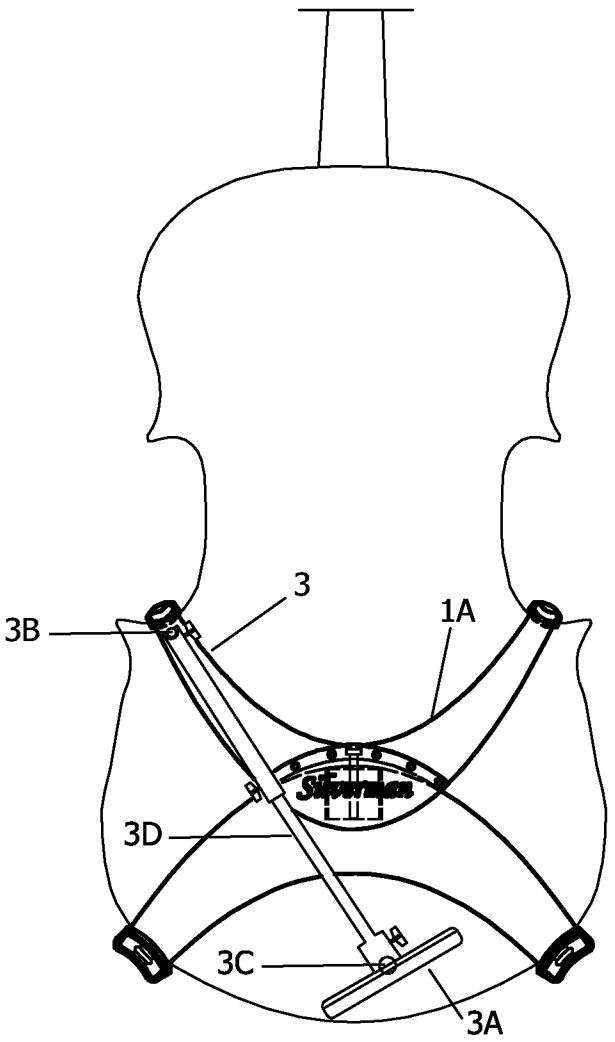
FIG. 3 is a plan view of the harness shown in FIG. 1 with a chest support arm installed.

In the embodiment of FIG. 3, an adjustable chest support arm 3 is attached to one end of the upper harness plate 1A using a rotatable joint 3B. The adjustable chest support is then extended until a stop pad 3A on the end of the arm engages the musician's body to provide hands-free support of the instrument while in the playing position. The adjustable chest pad can either be permanently attached to the upper harness plate at the rotatable joint 3B or can be readily separated from the harness using a quick-release strap-lock, such as, for example, a quick release used by modern guitarists. For low-profile instrument cases, the chest support arm is removable for placement elsewhere in the case when the instrument is stored. In another embodiment, a storing clasp can be installed on either of the plates for receiving and securing the adjustable chest pad support arm when the instrument is not being played or the musician is not in need of chest support arm.

In one embodiment, the plates are bound together by a single threaded fastener that is tightened after the rib tabs are placed at their proper positions. In another embodiment, the two harness plates are bound together by an alternate fastener comprising a standard worm gear ratcheting mechanism and a quick-release lever. Using this embodiment, the harness plates are expanded and retracted in one direction relative to each other by simply toggling the quick-release lever between a "loose" and "locked" position.

In continued reference to FIG. 2, a side view of the lower harness plate 1B is shown with the upper harness plate 1A behind the lower plate and extending into the background. The surface finish of the plates allows them to readily slide against each other. The lower harness 1B plate is rigid and is designed to retain its basic shape. Generally, the thickness of the plate that provides the requisite rigidity will vary depending on the type of material the plates are made from. Also, one method known in the art that can add rigidity to certain materials such as metals, is to break the edges at an acute angle to the plane of the plate. Adding rigidity using either edge-breaking or adjoining a stiffener to the plate will allow for lighter plate weight, thickness and manufacturing cost.

In reference to FIG. 3, an adjustable chest support is attached near one of rib tabs of the upper plate. The chest support consists of a telescoping arm 3 and a chest pad 3A which are connected to the harness with an upper rotatable joint 3B. The rotatable joints at 3B and 3C and the telescoping arm at 3D provide the chest support a wide range of adjustment options to accommodate different instrument positions and different body heights and orientations during playing and can be readily collapsed into another position to fit in a violin case. The chest support arm can also hold the instrument in playing position without the musician's hand supporting the instrument neck. The rotatable chest pad 3A can also be fitted with a soft contact surface, such as a ⅜" foam pad, where it contacts the musician's body. Where the chest pad joins the telescoping arm, a lower rotatable joint 3C is placed to allow additional positioning of the chest pad to the musician's comfort. In one embodiment, the chest support arm can be readily detached at the rotatable joint 3B using a quick-release mechanism commonly used on guitar strap-locks. In another embodiment, a stowing clasp is attached to one of the plates so that the chest support arm is secured into a fixed position when the chest pad is not being used.

Figure 4:
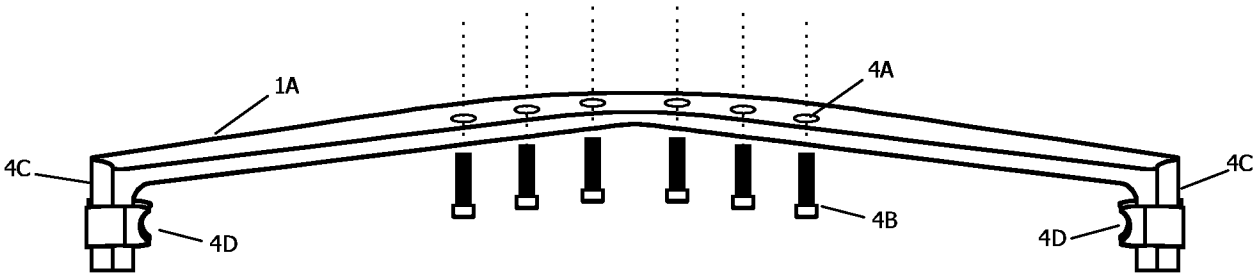
FIG. 4 is a side view of the upper harness plate and the plurality of fasteners that secure the guide rail to the upper harness.

In reference to FIG. 4, a side view of the upper harness plate is shown. The upper harness plate can also be profiled to match the contour of the instrument. In one embodiment, the upper harness plate is smoothly curved. The upper harness plate 1A can be made from the same material as the lower harness plate and of a similar construction to the various embodiments disclosed. The edges of the upper harness plate can also be broken (i.e., bent in a stiffening brake) to increase the rigidity of the plates. A plurality of fastener holes 4A are inserted into the upper plate symmetrically about the centerline of the plate to receive fasteners 4B that secure the upper and lower plates together. A pair of rib tabs 4C extend at a right angle from the centerline of the plate and include a pair of soft saddles 4D that engage the instrument. In one embodiment, the rib tabs of the upper plate have a convex profile that more closely matches the concave profile of the C-bouts at points of contact.

Figure 5:
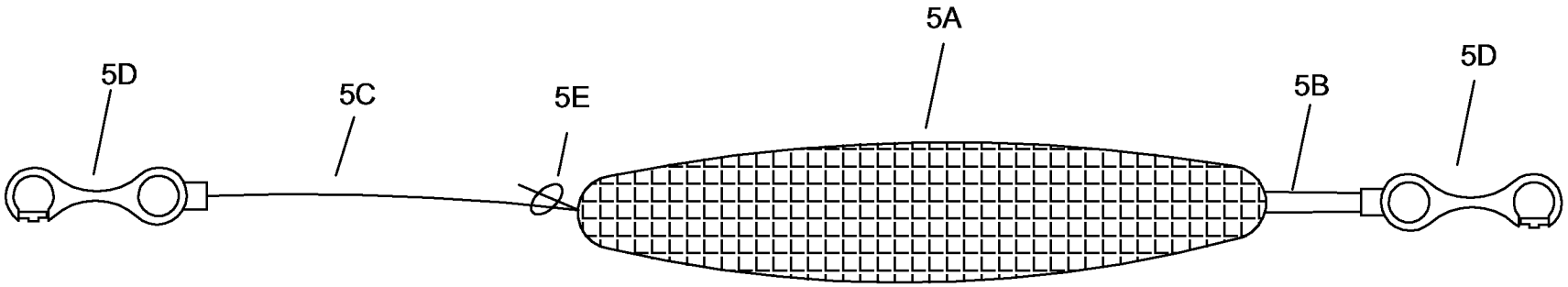
FIG. 5 is a view of a typical padded neck strap that can be connected to the harness.

In reference to FIG. 5, a standard neck strap is shown for use with the instrument body harness. An adjustable, padded neck strap (such as the kind used for a saxophone) attaches to the harness at one or more of the harness plates using quick-release clasps 5D. The area contacting the musician 5A can be made of stretchable padding, such as foam. In one embodiment, the strap can be thickest in the middle where it contacts the musician's neck and tapered on the ends where it attaches to the harness. Typically, one end of the tapered strap pad terminates in a short synthetic cable 5B which includes a swivel quick-release thumb clasp 5D. The other end of the tapered strap pad includes an extended, thinner synthetic cable 5C, due to the instrument being held somewhat to the side, and terminates into a second swivel quick-release clasp. At the point where the thinner cable meets the neck pad, there is also an adjustable clasp 5E that can vary the length of the thinner strap cable.

In reference to FIG. 6, a top view of the lower harness plate 1B is shown. The rib tabs 6A extend at a right angle away from the plane of the plate and contain a plurality of soft saddles that contact the top and bottom edges of the instrument. A threaded guide block 6B can either be centered and affixed to the top surface of the plate near the edge of the top arch 6C of the plate, be comprised of a threaded block placed within a similarly-sized recessed cavity into the surface of the lower harness plate, or be integrally formed in the upper or lower harness plate. In either embodiment, the threaded guide block provides a structure that extends upward from the plane of the plate and engages a similarly-sized cavity in the fastening block. The fastening block is secured to the lower harness plate using a single fastener 6D that is inserted through a hole in the side of the fastener block and into matching female threads 6E into the guide block 6B. With the fastener loosened around ½ to ¾ inch, the plates can separate outward relative to each other to fit around the instrument. The fastener is then tightened, which pulls the plates together and compresses the rib tab's soft saddles at their points of contact, securing the harness to the instrument. As a general matter, the requisite amount of saddle compression against the instrument imparted by tightening the fastener is predetermined for a given sized instrument and sets the general length, shape and angle of the harness plates. The length of the fastener is such that it can accommodate smaller variations in any given class of instruments. For example, since the body dimensions of a full-sized viola are generally larger than a violin, and the contours of the C-bouts and bottom body thickness are slightly different, the harness plate dimensions are proportionally increased or decreased to accommodate these differences. Violins are generally sized from "full scale," which equates to a 14" body length and 32" or 32½" overall length down to "1/32 scale, which equates to 7½" body length and 13 or 13½" overall length. Violas are generally sized from 16½" body lengths down to 12" body lengths. Even these dimensions can vary slightly from one manufacturer to another. In the one embodiment, the harness plates are sized and the rib tabs are profiled such that the harness can safely and surely fit the most number of violin and viola sizes or scales. Other embodiments of the invention can be scaled versions optimized to provide the requisite compressive force for any given scale of the instrument.

Figure 7:
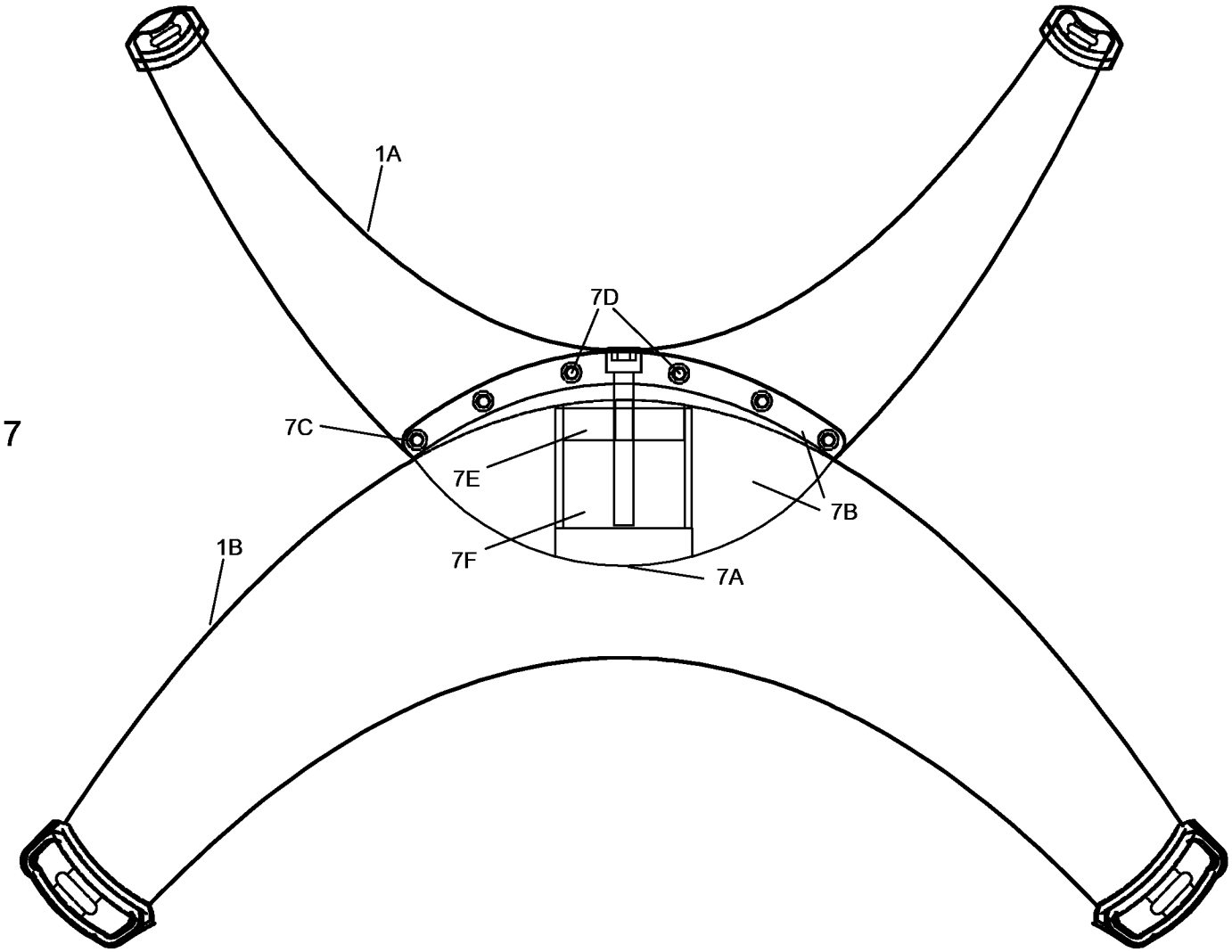
FIG. 7 is an enlarged version of the harness shown in FIG. 1 showing the upper and lower harness plates bound together and the fastening block with the single fastener of FIG. 6 in its tightened location.

In reference to the embodiment of FIG. 7, a part of the lower harness plate 1B overlaps the upper harness plate 1A up to the middle of the lower harness plate at 7A, which marks the lowest point of the arch in the upper harness plate. The required length and width of each plate is determined by the dimensions of the instrument body and this minimum overlap area of the plates up to the middle of the lower plate. Overlapping to the midpoint of the lower plate at 7A is the minimum distance that provides sufficient stability to the harness when the plates are secured together. The minimum overlap can vary depending on the strength and rigidity of the material used to form the harness. In one embodiment, the area of overlap of the two plates forms the shape of a prolate spheroid 7B, or an American football-shape. A similarly shaped fastening block 7C is placed on top of the lower plate over this area of plate overlap. The fastening block has a generally planar top and bottom sides, except for a guide rail 7C that extends away from the bottom face of the fastening block down to the upper face of the upper harness plate 1A. The fastening block and guide rail can be integrally-formed components. The guide rail binds to the upper harness plate while the tightening fastener binds the fastening, the upper harness plate and the lower harness plate together. A plurality of female fastener threads 7D are installed into the bottom face of the guide rail 7C. The curved shape of the guide rail 7C matches the curved shape of the lower harness plate 1B to facilitate assembly of the harness. The fasteners are positioned symmetrically about the centerline of the guide rail and are evenly-spaced apart. Holes matching this fastener pattern are bored through the upper plate. A threaded block 7E is either attached permanently to the upper face of the lower harness plate or it can be inserted into a corresponding recessed cavity into the upper face of the lower harness plate. A cavity 7F is formed inside the fastening block. As the tightening fastener is turned, the threaded block moves in one direction within cavity 7F. In the embodiment of FIG. 7, 6 evenly-spaced fasteners are shown and the alignment block is essentially square and aligned with the centerline of the harness plates.

Figure 8:
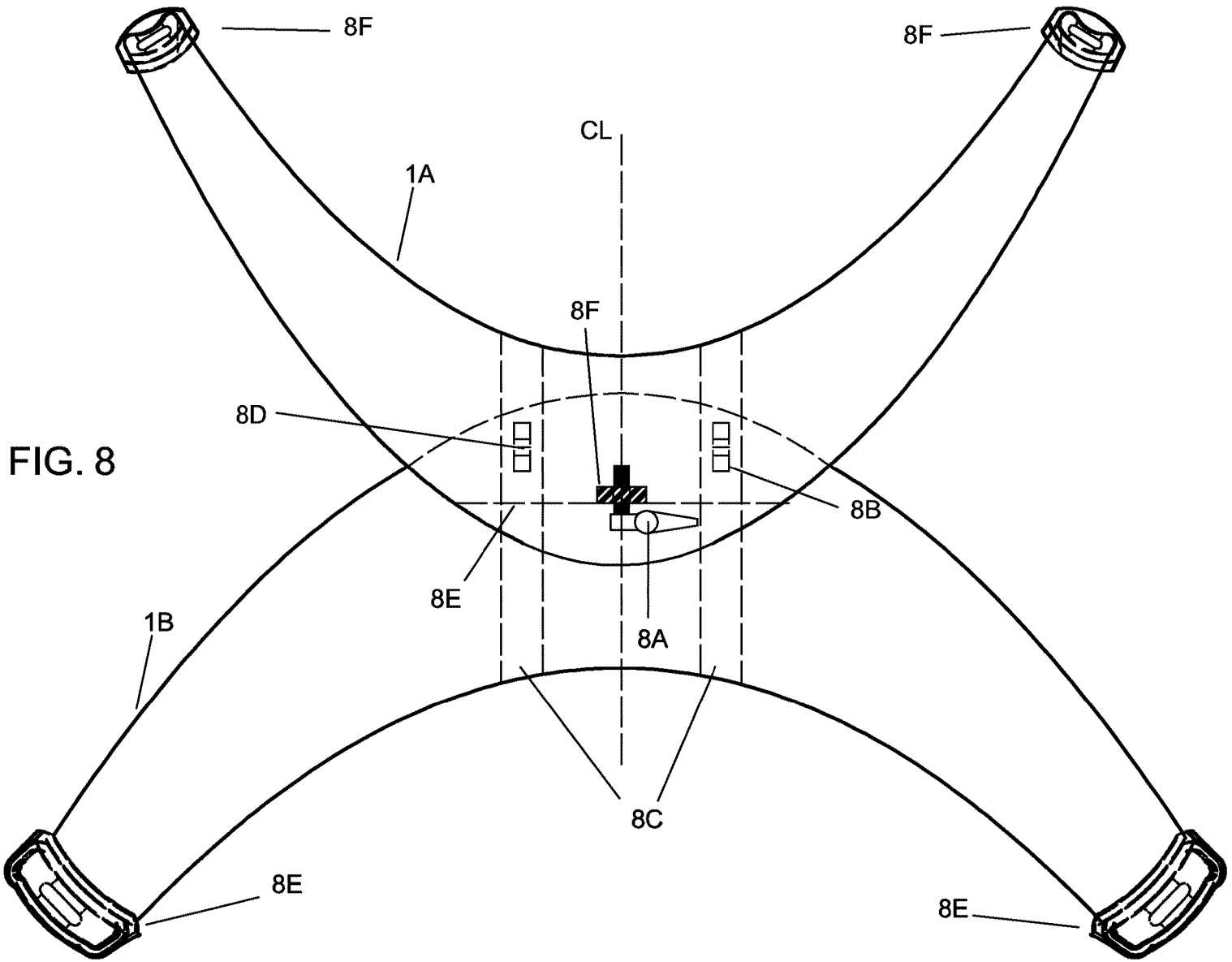
FIG. 8 shows another embodiment of the harness where the upper and lower harness plates are vertically adjustable relative to each other employing a worm-gear mechanism and a quick-release locking lever. Concave and convex guide channels are also formed into the upper and lower harness plates to add rigidity to the plates and horizontal stability of the plates relative to each other as they are vertically adjusted.

In the embodiment of FIG. 8, slightly different features are added to the harness plates to accommodate an alternate vertical adjustment and plate-locking mechanism. In this embodiment, a standard worm-gear type mechanism 8A is located near the middle center of the lower harness plate 1B. A plurality of rectangular slots 8B are installed into the upper plate. A corresponding plurality of rectangular, threaded tabs 8D extend upward from the lower harness plate through the rectangular slots 8B of the upper plate. The rectangular slots of the upper plate are larger in length than the rectangular tabs so that as the plates are vertically adjusted, the tabs move within the rectangular slots. The width of the rectangular slots is more closely sized to the width of the rectangular tabs so that the upper harness plate remains properly aligned with the lower harness plate during movement. Two rounded groove contours 8C can be formed into the lower harness plate which fit into corresponding groove contours of the upper harness plate. The contour of the upper plate can be convex relative to the instrument while the matching contour of the lower plate can be concave so to minimize localized contact with the instrument. As with other embodiments disclosed, the overall contour of the plates can be customized for different instruments or be sufficiently rounded to accommodate the instrument models with the greatest arches. The bottom end of the lower harness plate terminates into two rib tabs 8E, which grip the edge of the instrument and provide attachment points for the strap.

In continued reference to the embodiment of FIG. 8, the lowermost end of the upper plate arch is segmented at 8E to accommodate the vertical adjusters 8A. A plurality of rectangular slots 8B receive matching rectangular tabs extending outward from the surface of the lower plate. It should be noted that in the embodiment of FIG. 8, the upper plate overlays the top surface of the lower plate. Whereas, in the embodiment of FIG. 7, the lower plate over lays the top surface of the upper plate. In either configuration, the overlap extends at a minimum to the midpoint of the lower plate, or slightly more, to maximize the rigidity of the plates when secured together. A threaded guide nut 8F is attached to and extends outward from the bottom surface of the upper harness plate. The guide nut is aligned with the centerline of the upper plate and receives a male thread screw that is rotated into the threads by toggling the worm gear and quick-release lever mechanism. The rectangular posts 8B can be designed to include other shapes, such as cylindrical or triangular, as the posts primarily form guides that prevent horizontal movement of the plates while allowing limited vertical movement.

In continued reference to FIG. 8, the vertical adjustment mechanism 8A provides a reliable and securable method for moving the harness plates relative to each other until the upper rib tabs 8F engage the C-bouts. The worm-gear, quick-release lever mechanism is known in the art and is a similar mechanism installed on some guitar headstock e-string tuners. When the locking nut is released, the tuning of the string changes to a preset position (e.g., going from a standard E note to a D note). Although the linear distance change these worm gear, quick-release levers provide is generally limited, they are nonetheless suitable for adaptation to the harness plates as the extent of vertical adjustment required for most violins and violas is less than ¾" of an inch. Once the travel stop of the mechanism is set for a given instrument, the musician need only open or close the quick-release locking lever to secure remove or secure the harness to the instrument body.

Figure 9:
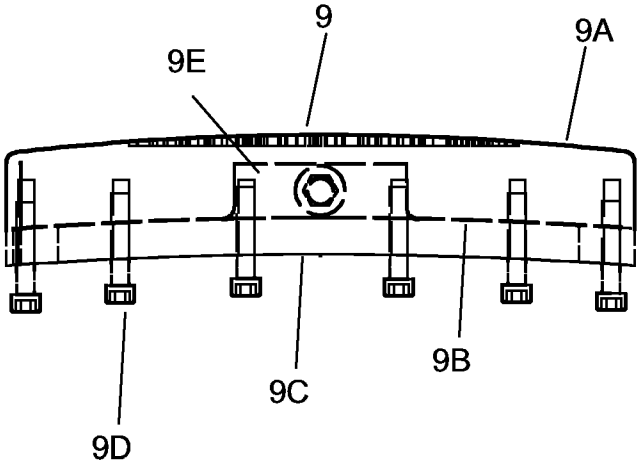
FIG. 9 is a side view of the fastening block of one embodiment of FIG. 7 which shows the guide block cavity, the guide rail and the harness fasteners are shown in their final position. Portions of the bodies of the upper and lower plates are also shown in their relative position.

In reference to FIG. 9, a side view of the fastening block used with another embodiment is shown. The fastening block 9 consists of a prolate spheroid shape with substantially planar top and bottom faces 9A and 9B, respectively and an arching guide rail 9C that extends down below the fastening block to contact the upper surface of the upper harness plate. The arch of the guide rail 9C generally matches the convex profile of the of the lower harness plate (see FIG. 7, at 7C). The overall height of the fastening block is generally determined by the length of fasteners selected. The guide rail 9C extends below the edge of the upper edge of the lower harness plate down to the upper face of the upper harness plate. Since the guide rail 9C is curved to match the convex profile of the lower harness plate, the fastening block and lower harness plate readily fit together and only further require the alignment of the fastener holes in the upper harness plate to the female threads of the guide rail and insertion of the fasteners to complete the harness assembly. A plurality of fasteners 9D are symmetrically distributed about the centerline of the guide rail and are evenly spaced apart. A cavity 9E is formed in the fastening block for receiving the guide block (see FIG. 6, item 6D). Finally, a hole is inserted into the side wall of the fastening block for receiving the threaded section of the tightening fastener (see FIG. 6, item 6E). When tightened, the fastener head pulls the upper harness plate toward the lower harness plate and ultimately binds the harness components together securely. The fastening block of FIG. 9 can be used with the embodiments shown in FIGS. 1-4, and 6-7.

In reference to the embodiment of FIG. 8, the locking quick-release lever binds the two plates together when placed in the "locked" position. When the lever is flipped to the "unlocked" position, the rectangular slots and guides as well as the groove contours allow vertical movement but prevent horizontal movement between the two harness plates. In reference to this embodiment, the tightening fastener and insert block perform essentially the same translational functions of movement and control.

In one embodiment, the harness plates are cast into a single, non-vertically-adjusting harness system. In this embodiment, the stiffness of the composite harness plate and or the rib tabs would provide a spring force that secured the harness to the instrument. If formed from an optimally flexible material, the musician could bend back slightly the rib tabs and the harness plates and insert the harness on to the instrument body. When the tabs and or harness plates flex back their normal position, a binding force is applied that compresses the soft saddles to the instrument securely. For the composite body embodiment, the harness plate and rib tabs can be uniformly coated with the compressible material to minimize the potential for wear between the harness and the instrument.

In other embodiments of the disclosed device, the device uses instrument clamps (similar to those used to attach a chin rest to a violin) to attach the device to the c-bouts of a stringed instrument. In such an embodiment, the harness supports the stringed instrument using a support arm (e.g., a shoulder rest, chest support, shoulder brace, chest brace, or other bracket, brace, or support) sits under the instrument and attaches to the sides of the instrument using the instrument clamps. In such an embodiment, the support arm can attach to the instrument on a single side (for example, at one of the lower c-bouts). In such an embodiment, a stabilizer can be used to stabilize the instrument in the harness on the support arm. Such stabilizer can attach to another part of the instrument, in one embodiment, at an opposite side of the c-bout from the attachment point of the support arm. The stabilizer keeps the instrument from swinging or rotating and provides additional support to the instrument and the support arm. A person having ordinary skill in the art will appreciate that the principles between such an embodiment with a support arm and an embodiment having harness plates operate using similar principles, but use different clamps to fasten the device to the instrument.

Figure 10:
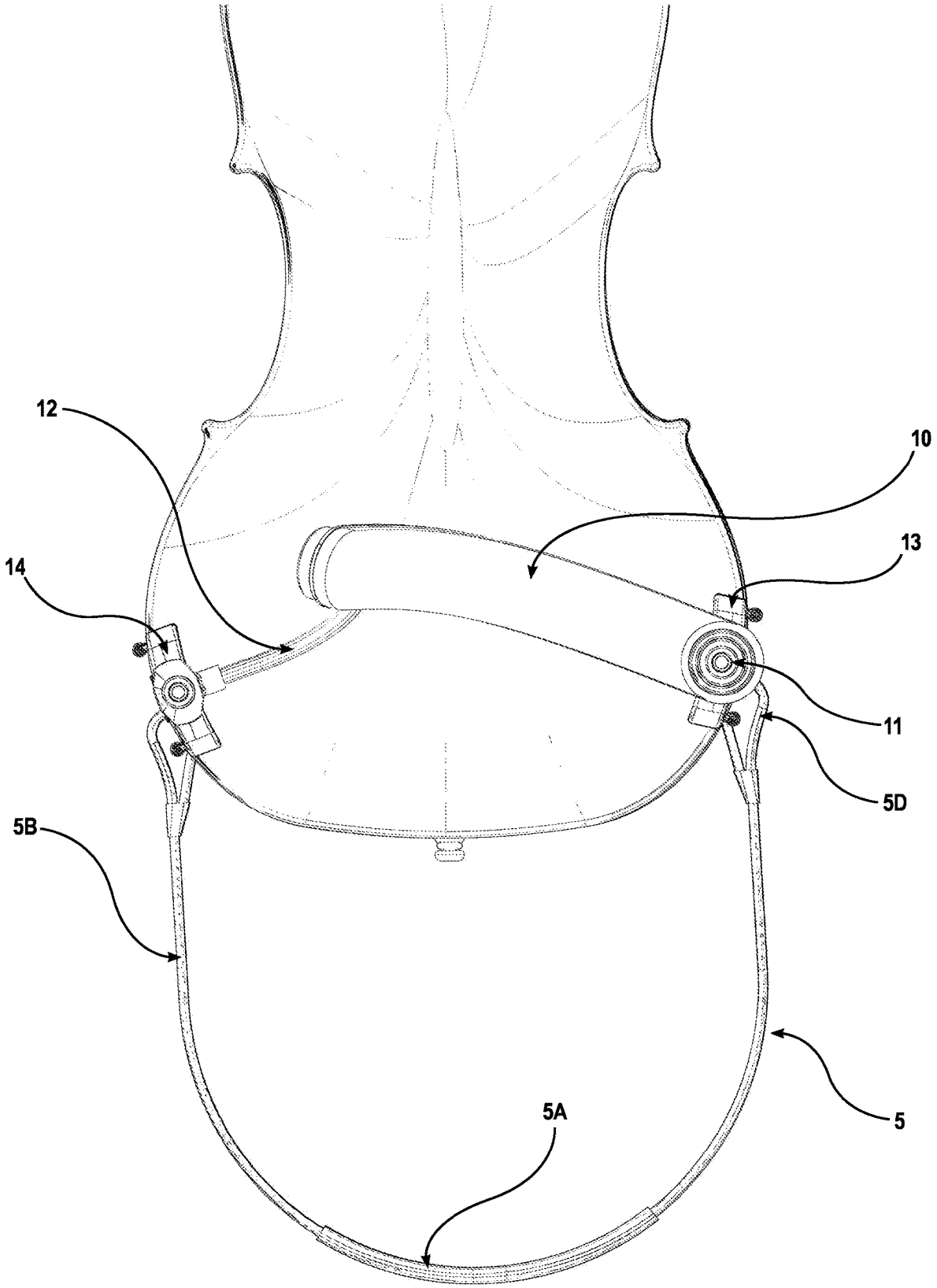
FIG. 10 is a bottom view of one embodiment of the device attached to the lower bouts of an instrument showing a neck strap, shoulder rest, stabilizer, and clamps.

As shown in FIG. 10, in one embodiment, a harness comprises two instrument clamps 13, 14. In one embodiment, these instrument clamps 13, 14 are identical and in another embodiment they are mirror images, reversely arranged or direct opposites. In one embodiment, these instrument clamps 13, 14 are standard, commercially available instrument clamps, such as clamps commonly found on chin rests for violins.

Also as shown in FIG. 10, in one embodiment, the device comprises a support arm 10 attached on one end to a first instrument clamp 13. In some embodiments, the support arm is a cantilevered shoulder rest or a cantilevered support arm (e.g., a shoulder rest, chest support, shoulder brace, chest brace, or other bracket, brace, or support) that attaches near a side of the instrument and acts as a counterbalance against a neck strap to support a stringed instrument and hold the instrument in place. In such an embodiment, the device can also comprise a stabilizer 12 attached to a second instrument clamp 14. In one embodiment, the device comprises a neck strap 5, having two ends, generally, 5B and 5D. In one embodiment, the neck strap 5 comprises padding for a user's neck 5A. In one embodiment, the device comprises a quick release connector 11 (e.g., a ball-detent pin attachment) that connects the support arm 10 to the first instrument clamp 13.

Figure 11:
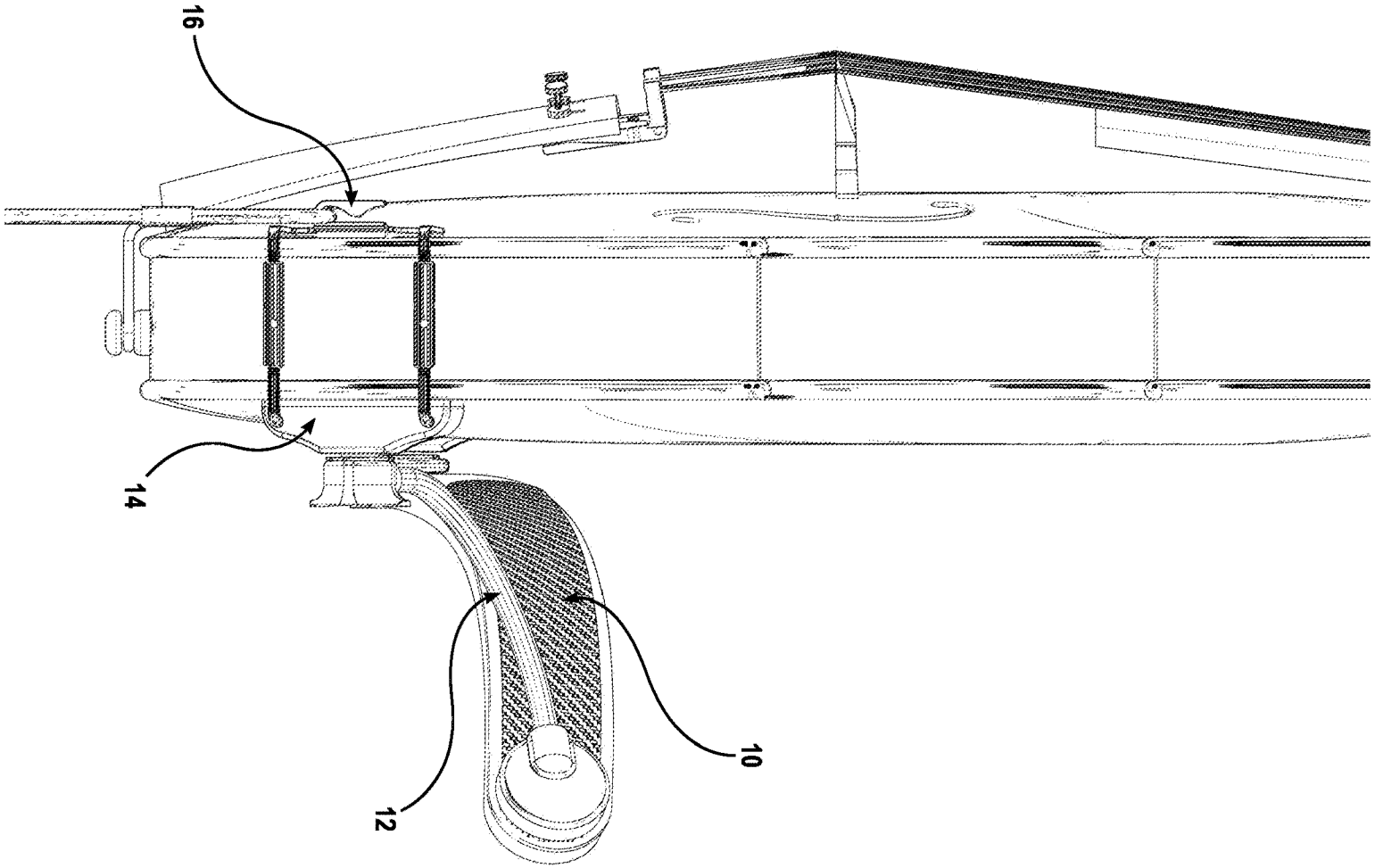
FIG. 11 is a right side view of one embodiment of the device attached to the lower bouts of an instrument showing the stabilizer, the stabilizer clamp, and the shoulder rest.
Figure 12:
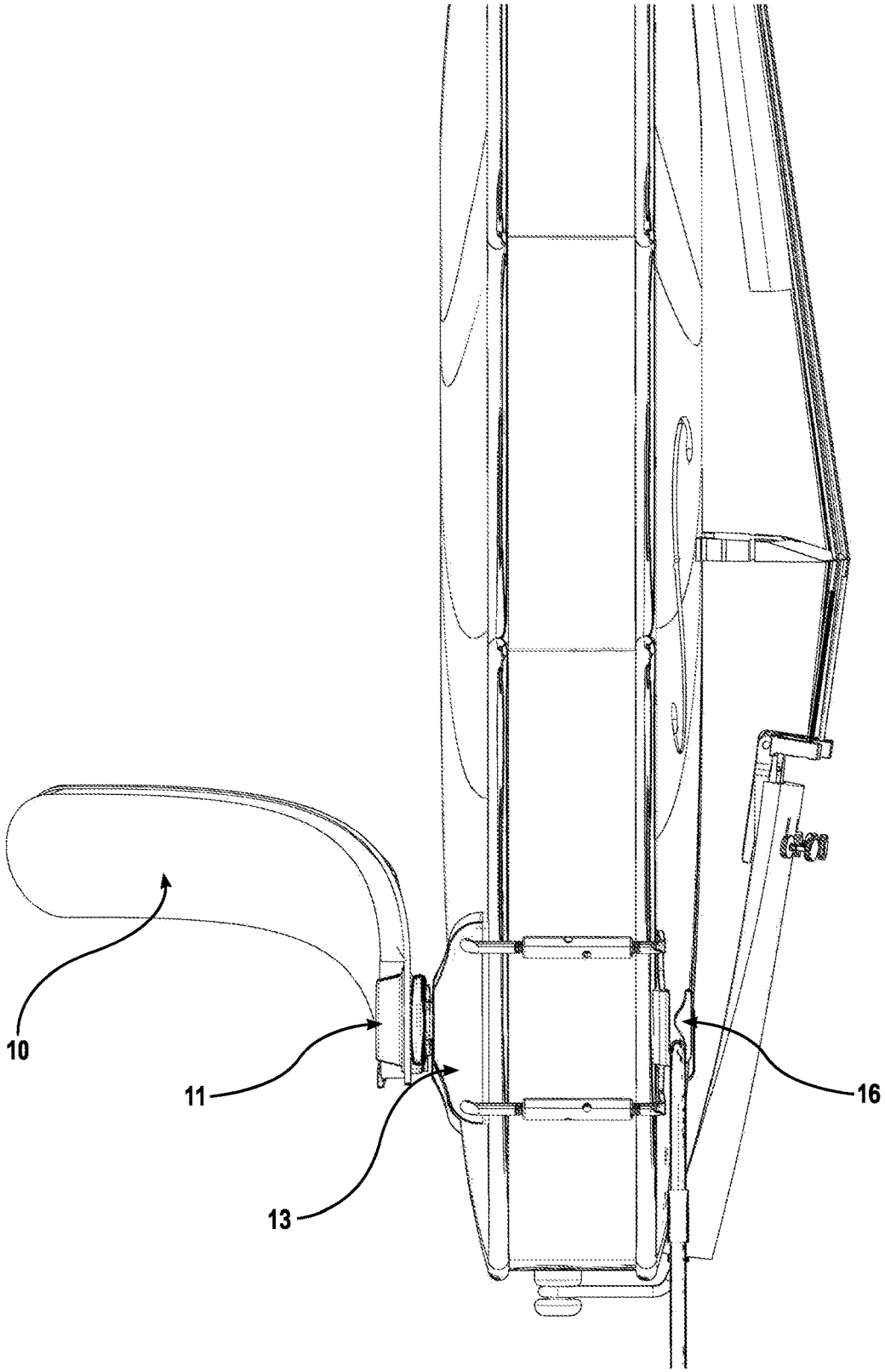
FIG. 12 is a right side view of one embodiment of the device attached to the lower bouts of an instrument showing the shoulder rest clamp, and the shoulder rest.

As shown in FIGS. 11 and 12, in one embodiment, the instrument clamps 13, 14 are each configured to receive one of the two ends 5B, 5D of the neck strap 5. In one embodiment, the instrument clamps 13, 14 have a hook 16 on a top side of the instrument clamp 13, 14. In other embodiments, another type of attachment point other than a hook can be used. In one embodiment, one instrument clamp 14 is connected to the stabilizer 12 and the other instrument clamp 13 is connected to the support arm 10. In one embodiment, the support arm 10 is detachably connected to the stabilizer 12. In one embodiment, the instrument clamps 13, 14 are detachably connected to the support arm 10 and the stabilizer 12, respectively. In one embodiment, the support arm 10 is cantilevered, and so the stabilizer 12 relieves some of the strain on the support arm 10 and acts as a brace or buttress for the support arm 10.

Figure 13:
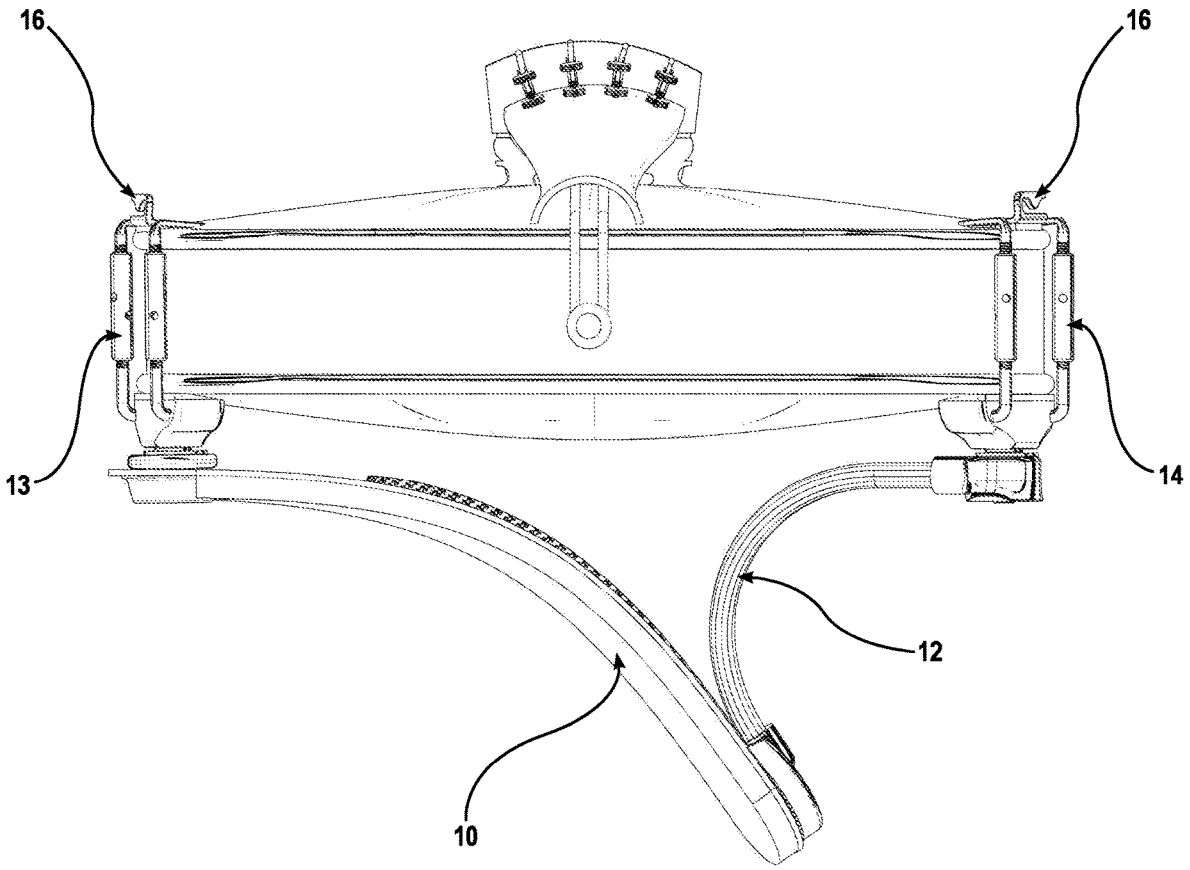
FIG. 13 is a side view of one embodiment of the device attached to the lower bouts of an instrument showing the shoulder rest, shoulder rest clamp, the stabilizer, and the stabilizer clamp.

FIG. 13 shows another view of the same embodiment shown in FIGS. 11 and 12. In such an embodiment, instrument clamp 13 has a hook 16 on the top side and clamp 14 also has a hook 16 on the top side. The bottom side of instrument clamp 13 attaches to the support arm 10 and the bottom side of instrument clamp 14 attaches to the stabilizer 12. A person having ordinary skill in the art will appreciate that instrument clamps 13 and 14 can be interchangeable in one embodiment and that the device setup can be reversed for a left-handed player.

Figure 14:
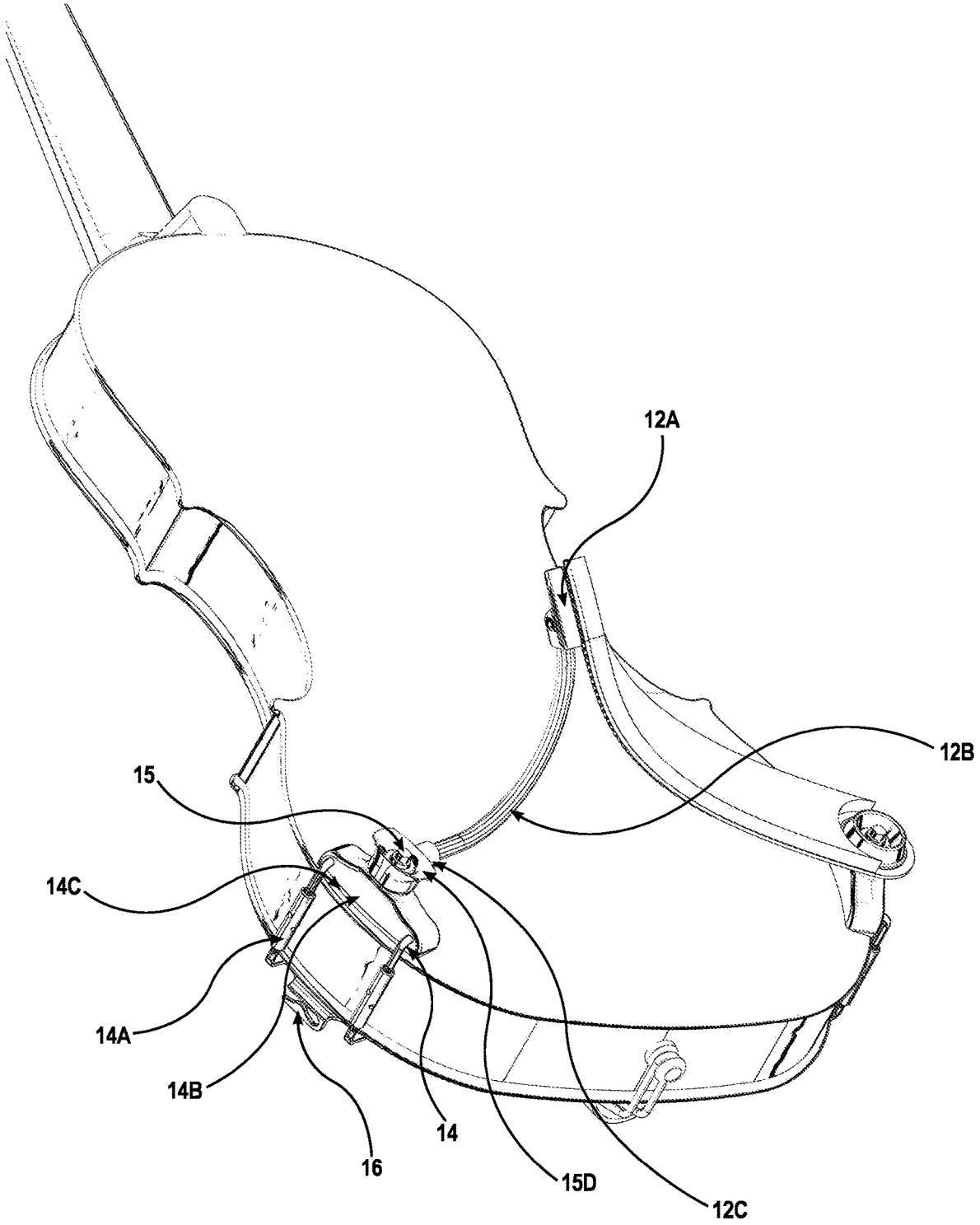
FIG. 14 is a perspective view of one embodiment of the device attached to the lower bouts of an instrument showing the shoulder rest, shoulder rest clamp, the stabilizer, and the stabilizer clamp.

In one embodiment, it can be useful to divide the stabilizer 12 into two halves, a non-clamp end and a clamp end when describing where the stabilizer 12 connects to the support arm 10. A person having ordinary skill in the art will recognize that the non-clamp end and clamp end are not necessarily exact locations. As shown in FIG. 14, in one embodiment, the stabilizer 12 has a non-clamp end 12A, a body 12B, and a clamp end 12C. In one embodiment, the clamp end 12C has a flange 15D. The flange 15D can be used as a grasping point for a user when attaching and detaching stabilizer 12. In one embodiment, the flange 15D is optional. In one embodiment, the clamp end 12C of the stabilizer 12 attaches to an instrument clamp 14 with a fastener 15. In one embodiment, a different instrument clamp is used. For example, the instrument clamp shown in FIGS. 1 to 9 can be used or any other clamp or fastener suitable for holding (i.e., providing a binding force for) a stringed instrument.

Figure 15:
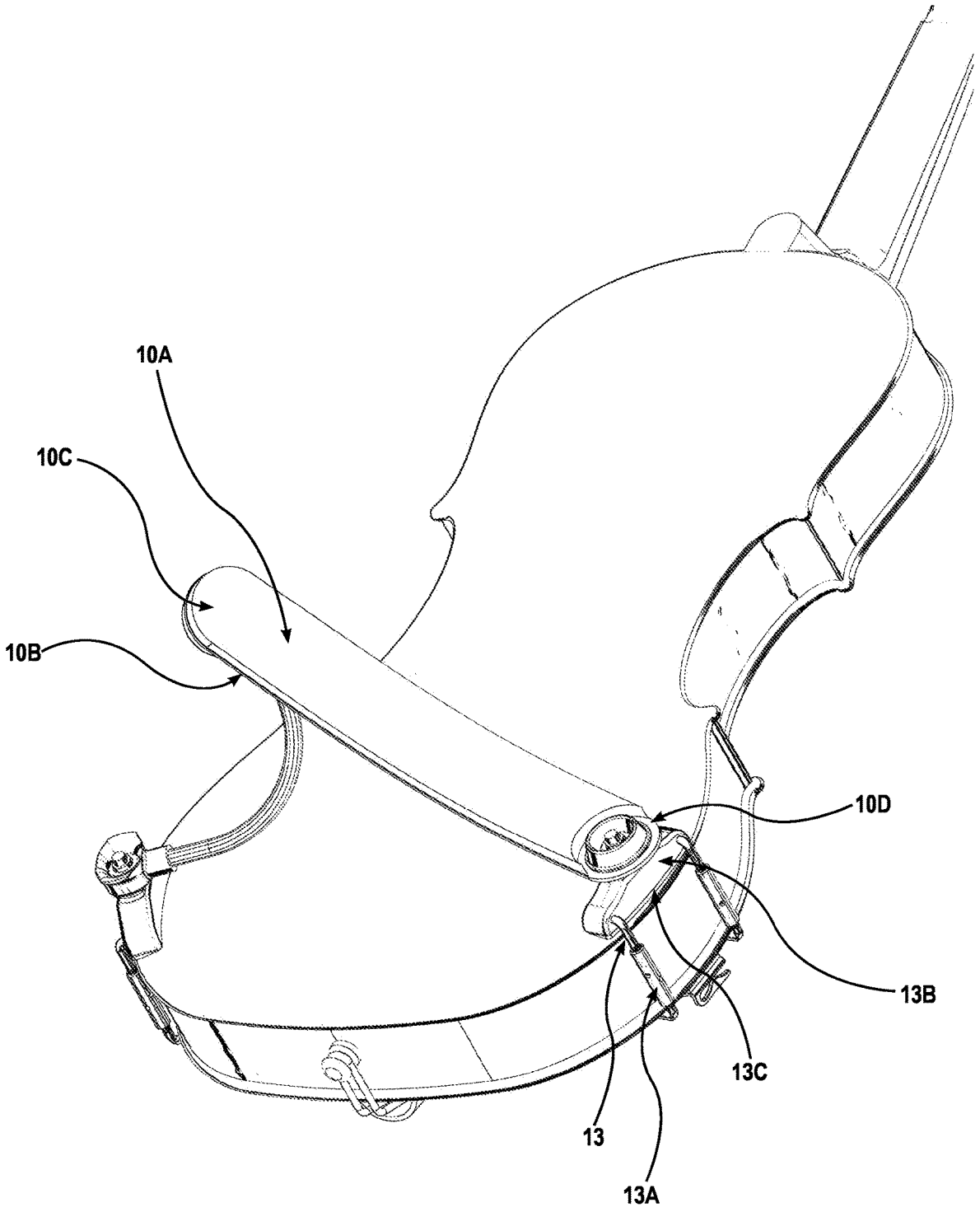
FIG. 15 is an alternate perspective view of one embodiment of the device attached to the lower bouts of an instrument showing the shoulder rest, shoulder rest clamp, the stabilizer, and the stabilizer clamp.

As shown in FIGS. 14 and 15, in one embodiment, clamps 13, 14 comprise one or more adjustable fasteners 13A, 14A, that allow the clamps 13, 14 to accommodate instruments having different thicknesses. Also as shown in FIGS. 14 and 15, the clamps 13, 14 have at least one moveable jaw 13B, 14B. Each of the movable jaws 13B, 14B have a cushion 13C, 14C or other soft saddle or compressible material to protect the instrument from the clamp 13, 14. The jaws 13B, 14B should not mar or damage the surface of the instrument. As mentioned before, the clamp can be substituted by another clamp or fastener suitable for holding a stringed instruments of varying widths, lengths, and thicknesses.

As shown in FIG. 15, in one embodiment, the support arm 10 comprises a cushioned or padded underside 10C on one surface that interfaces with a user's shoulder and/or chest and a rigid structure 10B that maintains the shape of the support arm 10 and resists bending under the weight of the instrument it supports. As with the stabilizer, in one embodiment, it can be useful to divide the support arm 10 into two halves, a non-clamp end and a clamp end in describing where the support arm 10 connects to the stabilizer 12. A person having ordinary skill in the art will recognize that the non-clamp end and clamp end are not necessarily exact locations. In one embodiment, the support arm 10 comprises a clamp end 10D where it attaches to the instrument clamp and a non-clamp end 10C. In one embodiment, the support arm 10 is made of aluminum or an aluminum alloy, steel alloy or other malleable metal. In one embodiment, the support arm 10 is approximately 1¼ inches wide, 9 inches long and ¾ inches thick. In one embodiment, the support arm 10 has approximately ½ inch padding on a 3/32 inch aluminum structure. In other embodiments, the support arm 10 varies considerably in width, length and thickness. For example, a version for a child would be much smaller than a version for an adult. In some embodiments more or less padding is used. In some embodiments the support arm varies in width, thickness, and/or height at different points.

Figure 16:
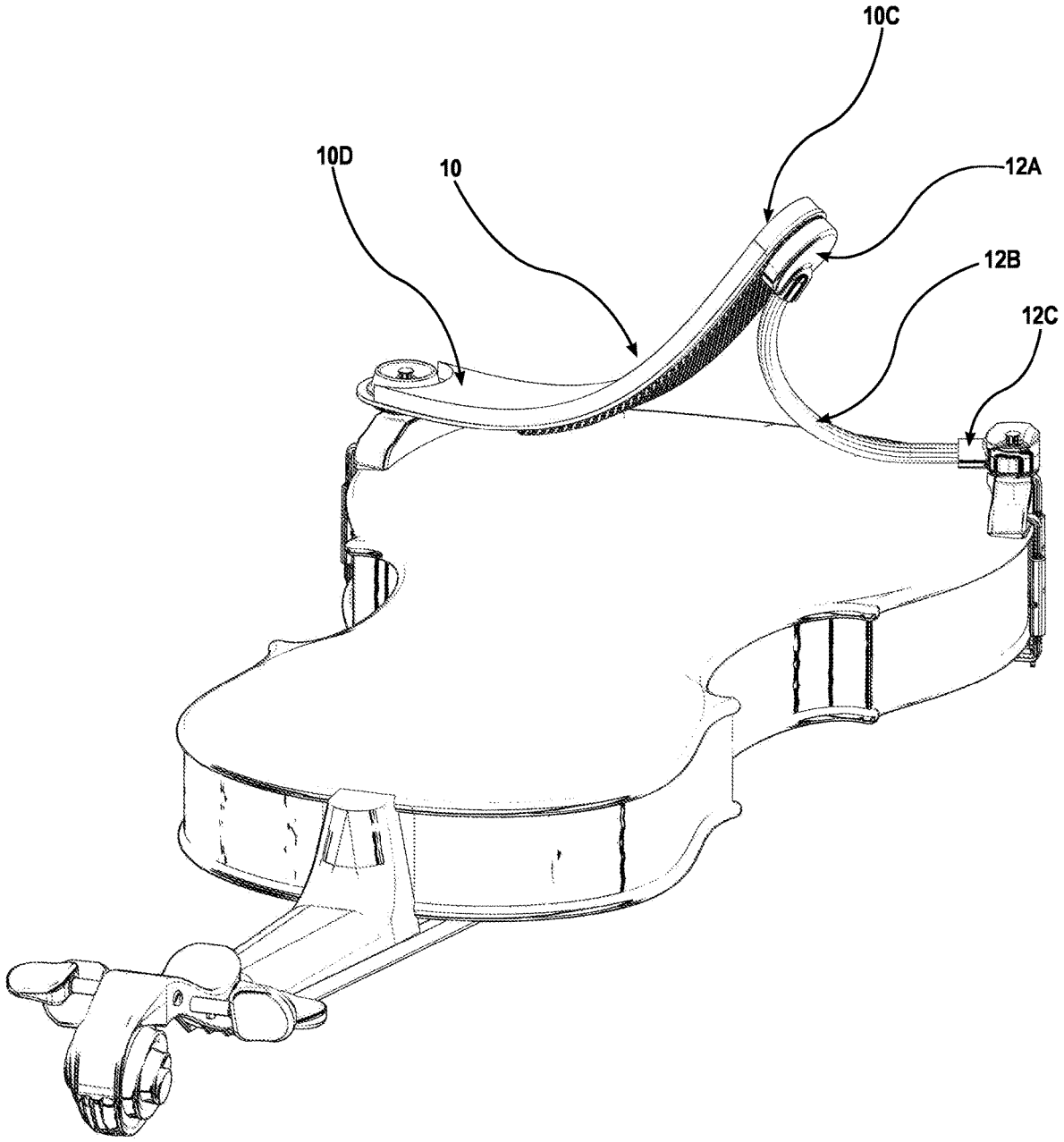
FIG. 16 is an alternate perspective view of one embodiment of the device attached to the lower bouts of an instrument showing the shoulder rest, shoulder rest clamp, the stabilizer, and the stabilizer clamp.

As shown in FIG. 16, in one embodiment, the support arm 10 curves and twists between its clamp end 10D and its non-clamp end 10C. As shown in FIG. 16, the exact location of the attachment point can vary along the non-clamp end 10C of the support arm (i.e., FIG. 16 shows a Velcro® surface that extends inward along the non-clamp end providing numerous attachment points for the stabilizer 12). In some embodiments, the curve provides support, which allows the clamp end of 10D of the support arm 10 to sit on a person's shoulder and exert upward support from the top of a person's shoulder while the non-clamp end 10C is simultaneously providing lateral support or resistance against the neck strap 5. The twist in the support arm 10 allows the non-clamp end 10C of the support arm 10 to directly resist the neck strap 5 when the device is on a person's shoulder and/or chest when the neck strap is around a person's neck and an instrument is attached to the device. In some embodiments, the twist in the body of the support arm 10 is needed because the direction of force from the neck strap 5 and the moment of force from the instrument are different than the direction of force required to hold the support arm 10 firmly against a person's shoulder and/or chest. Said another way, the curve in the support arm 10 should fit comfortably against a person's shoulder and/or chest, and, in one embodiment, the non-clamp end 10C extends downward on the person's chest, and the neck strap 5 extends from behind the person's neck forward and to the side but the device should allow all these forces to be equal keeping the instrument firmly placed in its intended position. Said yet another way, the non-clamp end 10C of the support arm 10 needs to be pulled firmly back against the person's shoulder, but the neck strap 5 pulls from an angle off to the side (part of the force pulls the support arm 10 back, but part of the force pulls the support arm 10 sideways toward the person's neck.) even though the moment of force from the instrument is at an angle to the user's body. Without the twist in support arm 10, in some embodiments, the support arm 10 would naturally flip or rotate toward the moment of force (load) exerted by the instrument. In one embodiment, the clamp end 10D takes most of the load, but the support arm 10 distributes part of the load to the non-clamp end 10C and the twist in the support arm 10 changes the direction of the load and distributes it straight back into the person's chest at the non-clamp end 10D. The support arm 10 has a twist so that it can receive the sideways or even diagonal (lateral) force of the neck strap received by the clamp end 10D and/or transfer a portion of that force back against the person's chest. In one embodiment, support arm 10 bears most of the load from an instrument, but the twist in the support arm 10, the non-clamp end 10C of the support arm 10, and the stabilizer 12 counteract the torque from the weight of the instrument.

Additionally, as shown in FIG. 16, in one embodiment, the stabilizer 12 attaches to the second clamp 14 and the body 12B of the stabilizer 12 bends and twists so that the non-clamp end 12A of the stabilizer 12 meets the non-clamp end 10C of the support arm 10. In one embodiment, the non-clamp end 12A of the stabilizer 12 attaches to the non-clamp end 10C of the support arm 10 by a hook and loop, Velcro®, mushroom fastening (e.g., DualLock®) strip or some other fastener. As shown in FIG. 16, the stabilizer attaches to the support arm 10 anywhere along the Velcro® surface or other fastener that extends inward along the non-clamp end providing numerous attachment points for the stabilizer 12. In an embodiment with a different type of fastener, multiple attachment points can be set on the support arm. The device can be used in a right-handed configuration, but it can also be in a left-handed configuration in which all of the components would be reversed and the stabilizer 12 attaches to the first clamp 13 and the cantilever should rest 10 attaches to the second clamp 14. In some embodiments, the features of the fastener used to connect the stabilizer 12 to the support arm 10 are that the fastener is silent (i.e., will not rattle or rub when the instrument is played), that the fastener is strong enough that it will not accidentally unfasten, and that it is not bulky so that it will not interfere with playing the instrument.

Figure 17:
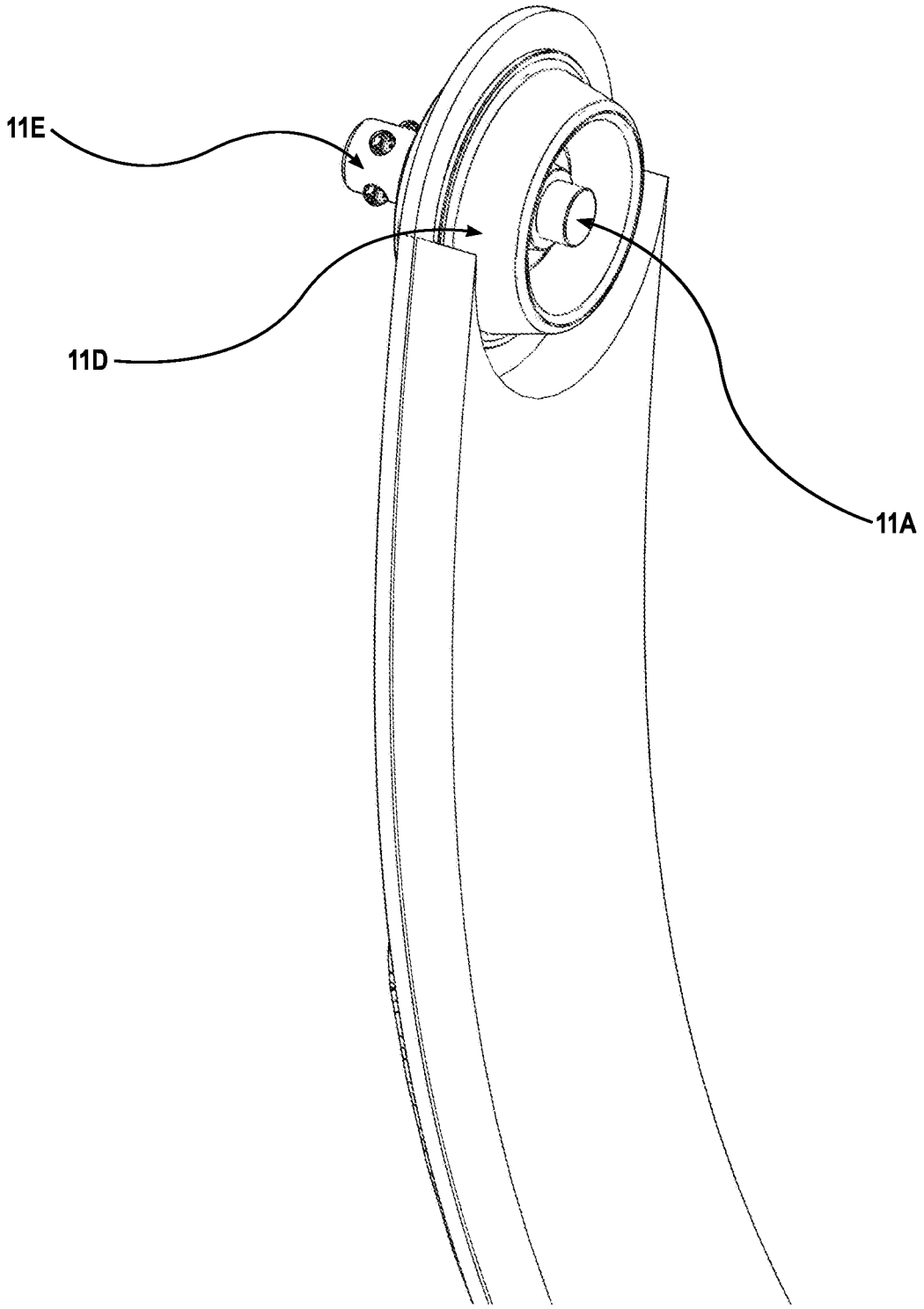
FIG. 17 is a perspective view of one embodiment of the shoulder rest of the device.

As shown in FIG. 17, in one embodiment, the clamp end 10C of the support arm 10 terminates in a ball-detent pin or other quick release mechanism 11E, which receives the clamp 13 and detachably connects the clamp 13 to the support arm 10 so that it cannot accidentally separate. As shown in FIG. 17, in one embodiment, the ball-detent pin 11E can be released by pressing a button 11A on the clamp end 10C of the support arm 10. In one embodiment, the button 11A is encircled by a flanged washer 11D. In one embodiment, the flanged washer 11D prevents the button 11A from accidentally being pressed. In one embodiment, the flanged washer 11D is optional.

Figure 18:
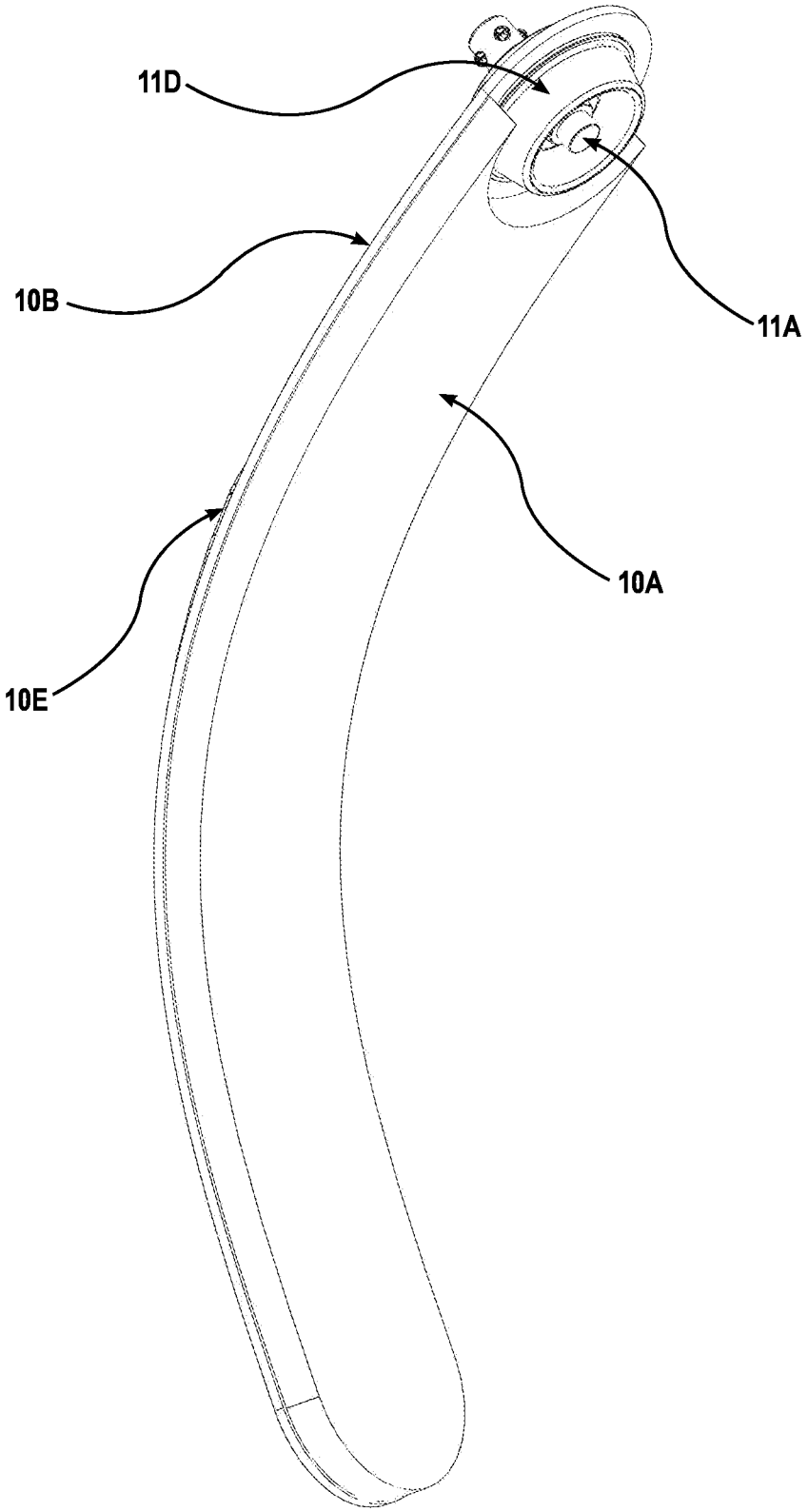
FIG. 18 is a perspective view of one embodiment of the shoulder rest of the device.

As further shown in FIG. 18, in one embodiment, the support arm 10 has two layers adhered together, a cushion layer 10A and a rigid body 10B. In one embodiment, the cushion is thicker than the height of the flanged washer 11D at the clamp end 10C of the support arm 10 so that a user cannot feel the flanged washer 11D or accidentally press the button 11A when the support arm is resting on the person's shoulder. In one embodiment, the support arm 10 has a third layer 10E that can have a hook and loop, Velcro®, mushroom fastening (e.g., DualLock®) strip or some other fastener 10E attached to the rigid body 10B. In such an embodiment, the stabilizer 12 can attach to the support arm anywhere on the third layer 10E.

Figure 19:
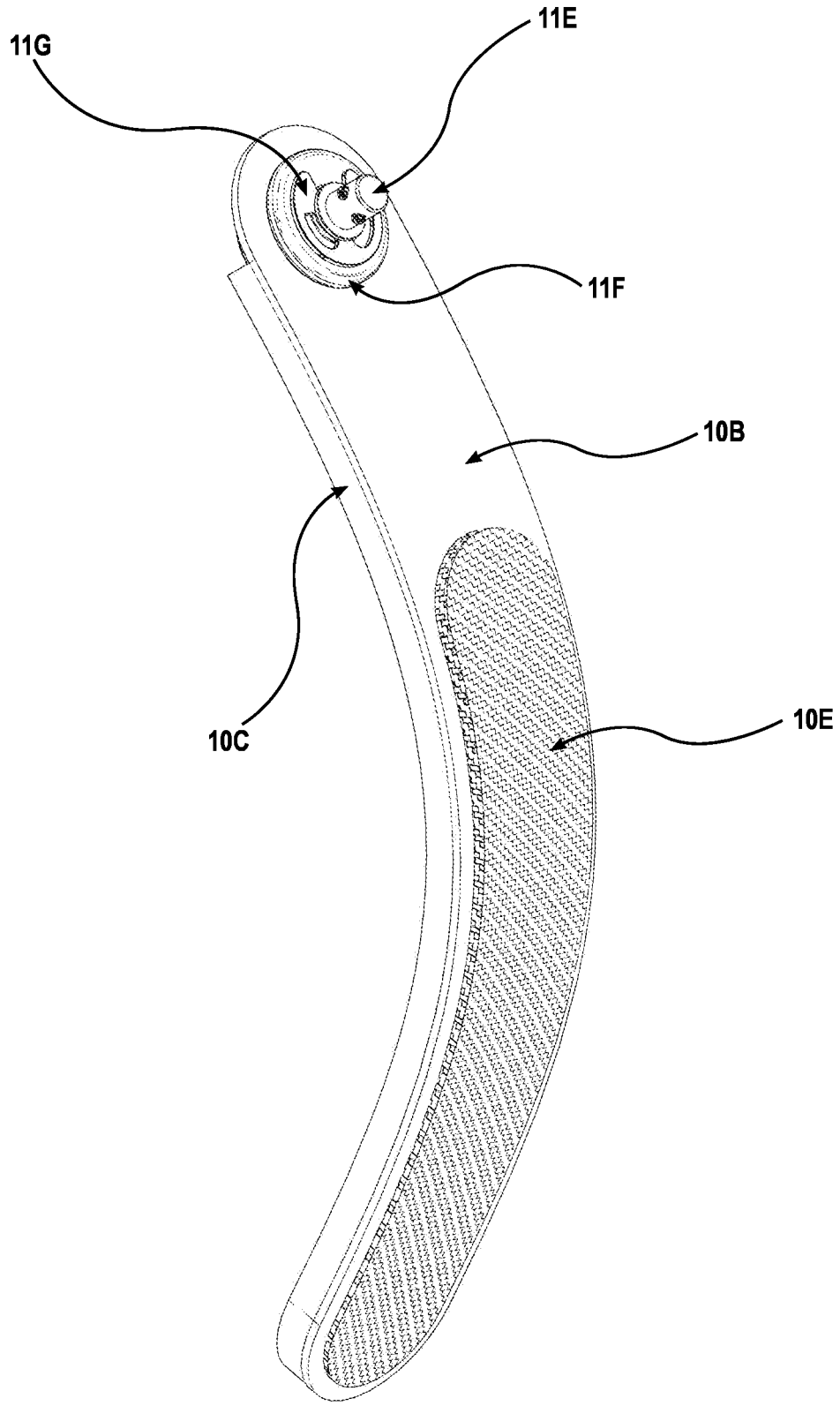
FIG. 19 is an alternate perspective view of one embodiment of the shoulder rest of the device.

As shown in FIG. 19, in one embodiment, the support arm 10 has a top side opposite the cushion 10C. In one embodiment, the top side is the rigid body 10B. In another embodiment, the top side is the third layer 10E. The third layer can be the entire stop side of the rigid body 10B or a portion of it. In one embodiment, the third layer 10E can be a decorative material. In an embodiment that uses a fastener other than mushroom fastening or hook and loop, the third layer can be omitted or be entirely decorative.

As further shown in FIG. 19, in one embodiment, the ball-detent pin 11E extends up from the top side of the clamp end 10D of support arm 10 so that its embedded bearings clear the top side of the support arm 10. In one embodiment, the ball-detent pin 11E is attached to the support arm 10 with a washer 11F and a washer, snap ring, e-clip, locking washer, nut, or other fastener 11G. In one embodiment, the washer 11F is a vibration-damping washer and in other embodiments, the washer 11F is omitted. In other embodiments, another type of quick-release connector is used instead of a ball-detent pin to connect the support arm 10 to the instrument clamp 13. In some embodiments, the connector between the support arm 10 and the instrument clamp 13 (e.g., the ball-detent pin) allows the instrument to rotate. In some embodiments, the connector between the support arm 10 and the instrument clamp 13 is not rotatable but is instead a non-rotating connector that holds the support arm 10 to the instrument clamp 13. In such a non-rotatable embodiment, the angle of the instrument relative to the support arm 10 is determined and fixed when the support arm 10 is attached to the instrument clamp 13.

Figure 20:
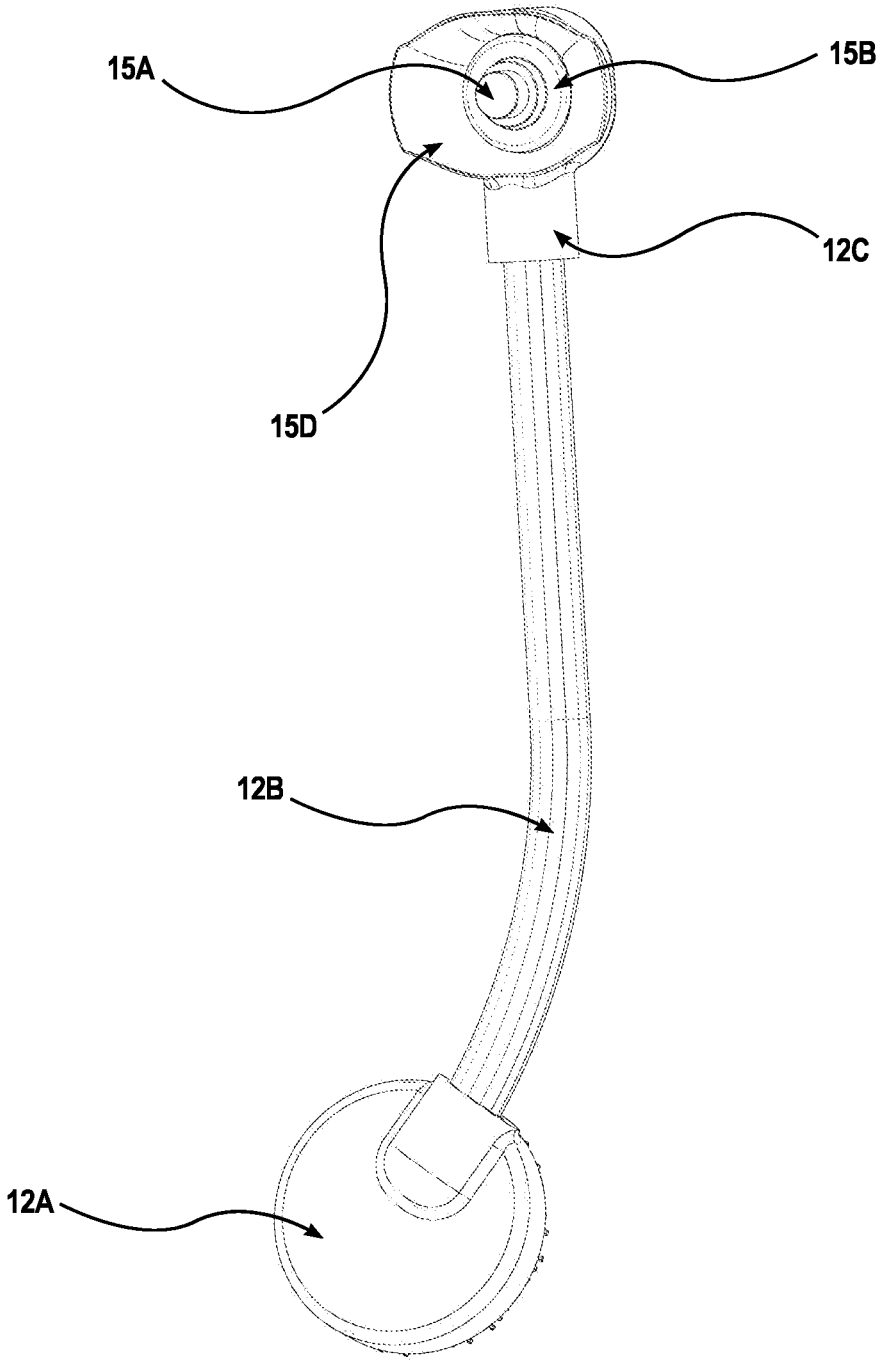
FIG. 20 is a perspective view of one embodiment of the stabilizer of the device.

As shown in FIG. 20, in one embodiment, the stabilizer 12 is a rubberized or polymer coated wire that can be bent to hold the support arm's 10 non-clamp end 10C in a person's preferred position. In such an embodiment, the wire is thick enough that it will not allow the support arm 10 to freely rotate. In such an embodiment, the wire is malleable enough that it can be shaped by hand to match the position of the support arm 10. In other embodiments, the stabilizer is rigid and cannot be adjusted. In such an embodiment, the amount of twist and bend in the stabilizer is pre-determined based on the position of the cantilever shoulder support 10. In one embodiment, the stabilizer is rod, wire, or plate made from carbon fiber, metal, or plastic. In some embodiments, the stabilizer is a thick wire or malleable metal plate so that it can be bent by a user when needed but hold a set position under the weight of a stringed instrument. In some embodiments, the stabilizer is straight and does not bend. In some embodiments, the stabilizer is not twisted. In one embodiment, the stabilizer is made of a steel alloy or other malleable metal. In one embodiment, the stabilizer is approximately an ⅛ inch diameter wire with approximately 5/32 inch padding wrapped around it and approximately 4 inches long. In other embodiments a larger gauge wire with more or less padding is used. The gauge wire may vary considerably as may the padding used. In embodiments using a metal bracket or brace the size and padding may vary considerably.

Additionally as shown in FIG. 20, in one embodiment, the stabilizer 12 can have a stabilizer body 12B that is a wire or cylindrical in shape. However, the stabilizer body 12B can be any shape or thickness. In one embodiment, the clamp end 12C of the stabilizer 12 ends in a flange 15D to assist a person as a grasping point when pressing button 15A to release the stabilizer. In one embodiment, the non-clamp end 12A of the stabilizer 12 ends in a head.

Figure 21:
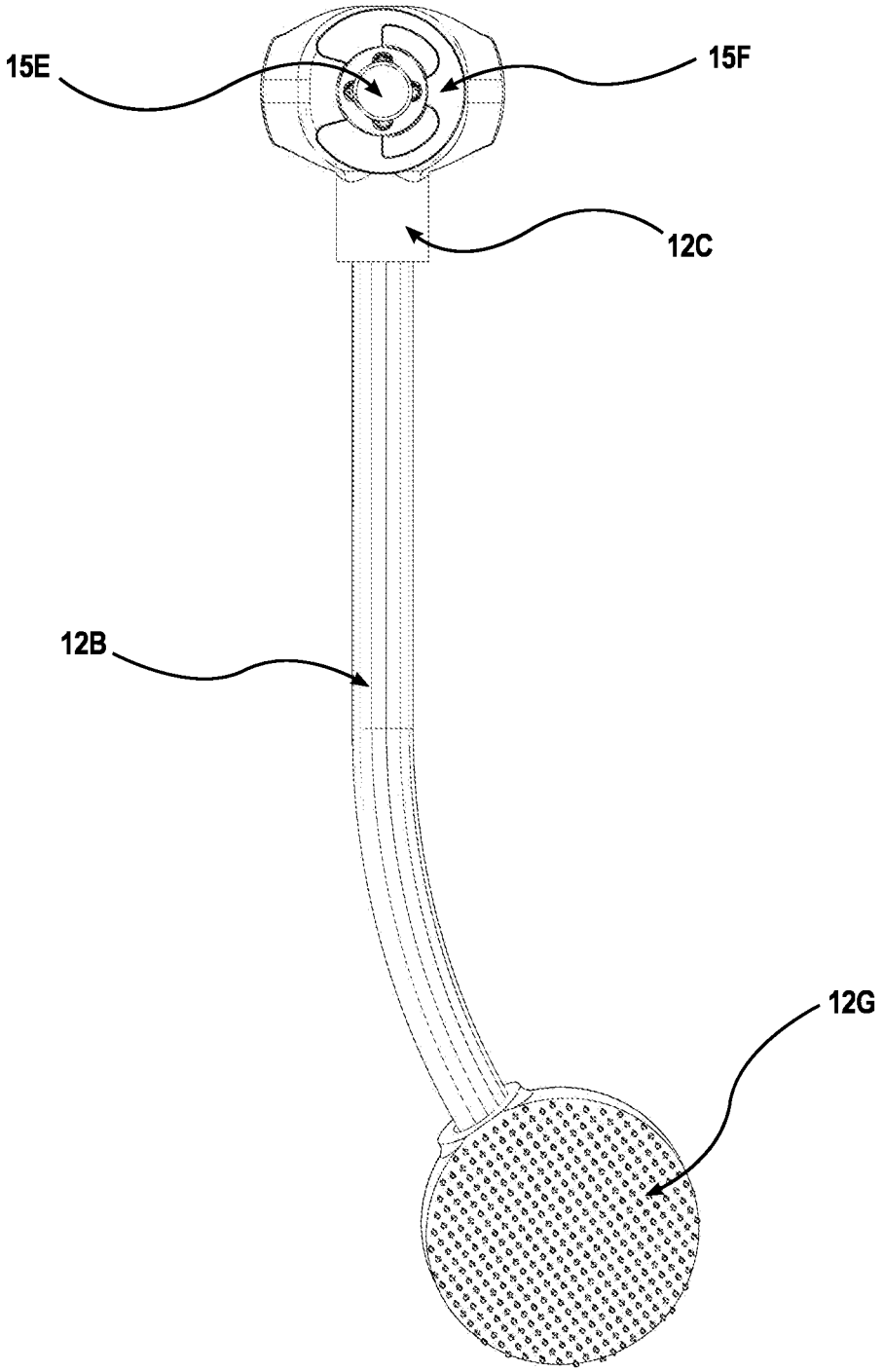
FIG. 21 is a bottom view of one embodiment of the stabilizer of the device.
Figure 24:
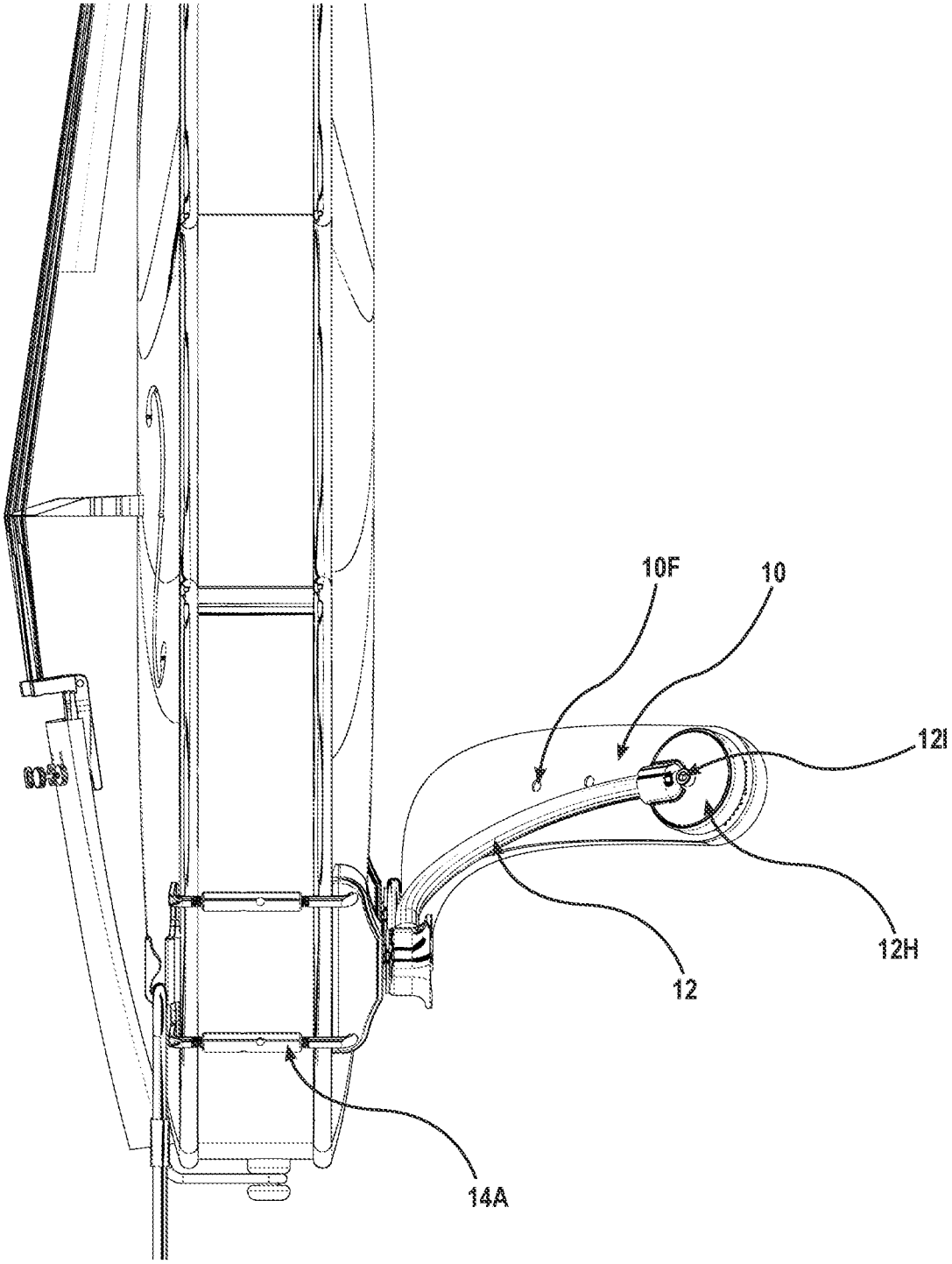
FIG. 24 is an alternate side view of one embodiment of the device attached to the lower bouts of an instrument and showing the support arm connected to the stabilizer.

As shown in FIG. 21, in one embodiment, the non-clamp end 12A of the stabilizer 12 can have a hook and loop, Velcro®, mushroom fastening (e.g., DualLock®) strip or other fastener 12G that allows the stabilizer 12 to attach to the cantilever support arm 10. In one specific example of another fastener, as shown in FIG. 24, the stabilizer 12 can have a hole for a machine screw 12I. In one embodiment, the hole is at the non-clamp end but it can be anywhere on the stabilizer 12. In such embodiments, the support arm 10 can have one or more threaded holes 10F or threaded fasteners to receive the machine screw 12I. The number of threaded holes 10F can vary to allow for flexibility on the exactly attachment point for the stabilizer as provided in other embodiments. The type of fastener can vary widely, as previously described. In one embodiment, the non-clamp end of the stabilizer 12 has a defined head 12H where the fastener is located, but in other embodiments the fastener can be anywhere along the stabilizer, including, as shown in FIG. 16 closer to the mid-point of the support arm (i.e., the Velcro® or adhesive fastener shown in FIG. 16 extends across the face of the support arm). The number of holes in the stabilizer can also vary. In one embodiment, the fastener on the stabilizer 12 attaches to the third layer on support arm 10. In other embodiments, any other detachable fastener can be used to connect the stabilizer 12 to the support arm 10.

In one embodiment, as shown, the clamp end 12C of the stabilizer 12 has a stabilizer ball-detent pin 15E and a washer, snap ring, e-clip, locking washer, nut, or other fastener 15F. In such an embodiment, when the stabilizer 12 is attached to the clamp 14, the stabilizer 12 can rotate around the ball-detent pin 15E when configuring the device. In some embodiments, the clamp end 12C of the stabilizer 12 has a fastener that is not rotatable and holds the stabilizer 12 in a fixed position relative to the clamp 14.

Although the embodiment shown in FIGS. 10 to 23 depict a support arm that detachably connects to a separate stabilizer, an alternate version of the device consists of a support arm that either has no stabilizer or has a stabilizer on the support arm. For example, one embodiment has a support arm with a wide non-clamp end and a non-rotatable attachment point. Such an embodiment uses the wide base of the support arm as leverage to prevent the device from rotating or flipping under the instrument's load and the non-rotatable attachment point prevents the device from rotating about the attachment point. For another example, on embodiment attaches the support arm to a belt or strap that fastens around the person's chest or waist and prevents the device from rotating or flipping out to the side under the instrument's load. In another embodiment, the support arm has a built in buttress that attaches to a second point on the instrument to stabilize the instrument in the device. Such a built in buttress may be malleable so that the device can be fitted to the person's body.

Figure 22:
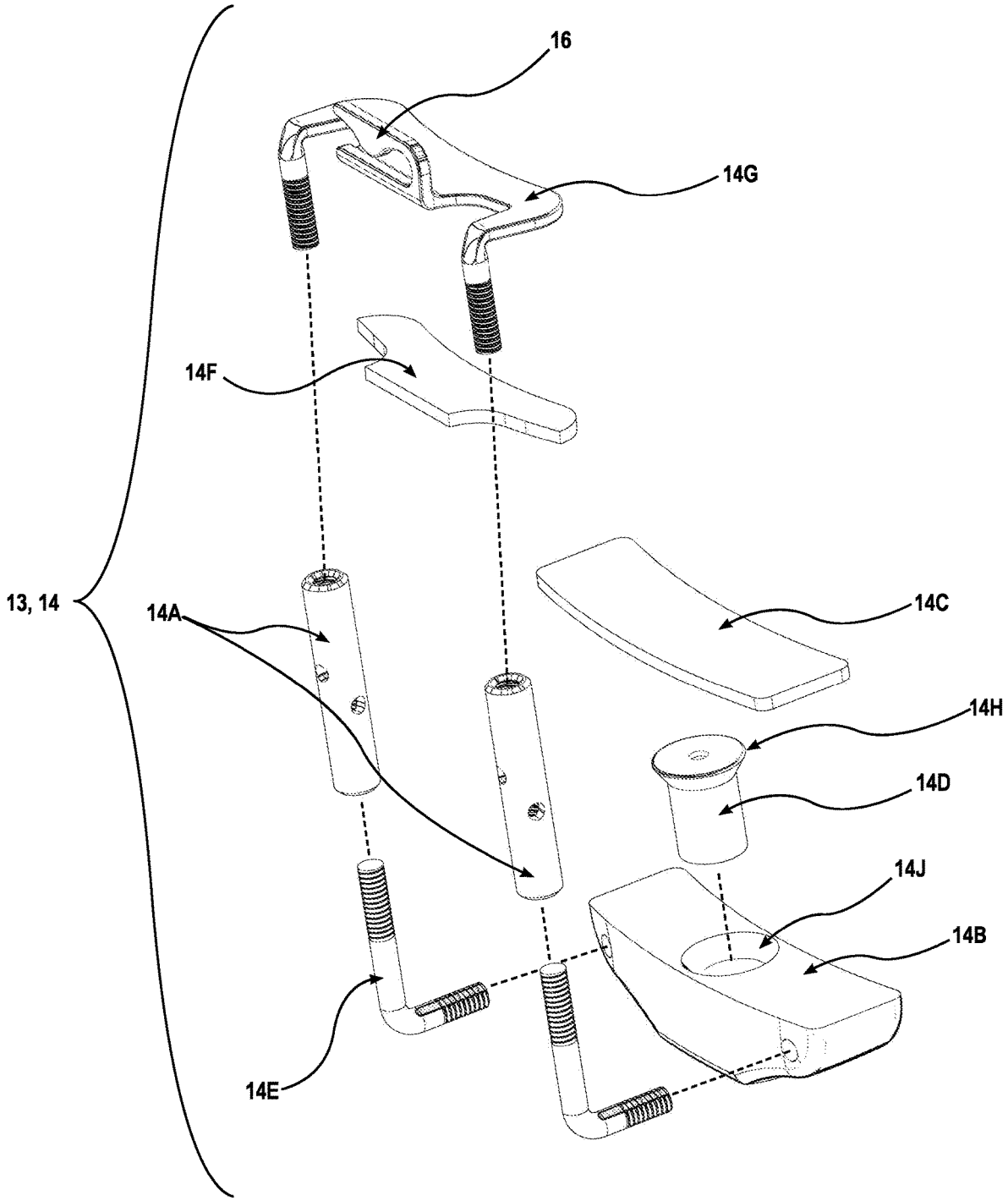
FIG. 22 is a blown apart view of one embodiment of the clamps for the device.
Figure 23:
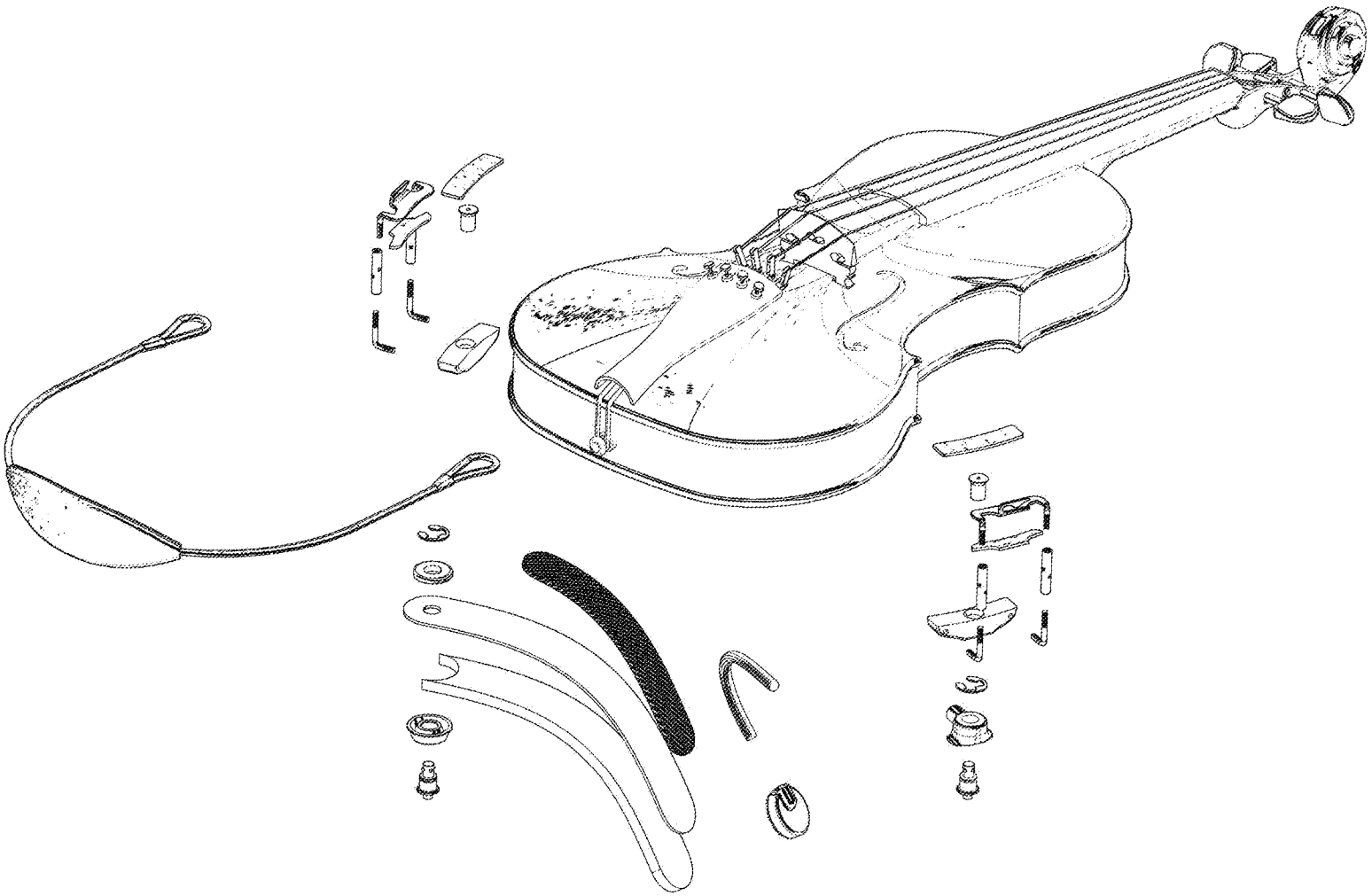
FIG. 23 is a blown apart view of one embodiment of the device and an assembled instrument.

FIG. 22 shows an exploded view of one embodiment of each of the clamps 13, 14. As discussed above, the clamps can be identical or they can be mirror images of each other. In one embodiment, each clamp fits around a different side of the instrument and attaches to the instrument without harming the finish on the instrument. As shown in FIG. 23, in one embodiment, each clamp comprises a lower jaw 14B, a pin catch 14D, a lower instrument pad 14C, a lower clamp fitting 14E, a fastener 14A, and upper clamp fitting 14G, and upper instrument pad 14F. In one embodiment, a hook 16 is integrally formed with the upper clamp fitting 14G for receiving a neck strap 5. In one embodiment, each of the upper instrument pad 14F and the lower instrument pad 14C are made of cork, rubber, or another polymer that absorbs vibration, resists transition of sound, and will not harm the finish of the instrument. In one embodiment, the clamp can be any standard clamp with alternative configurations, such as, for example: a lower jaw 14B can be integrally formed with the lower clamp fitting 14E; the lower clamp fitting 14E can be integrally formed with the fastener 14A; the lower clamp fitting 14E, the fastener 14A, and the lower jaw 14B can be integrally formed; the upper clamp fitting 14G and the fastener 14A can be integrally formed; and the upper clamp fitting 14G, the fastener, the lower clamp fitting 14E, and the lower jaw 14B can all be integrally formed. In one embodiment, a clamp is form fitted for a particular size instrument and cannot be adjusted to accommodate instruments having different widths. In one embodiment, a pin catch 14D has a flange 14H on one end that fits into a hole 14J in the lower jaw 14B. The pin catch 14D is countersunk, and the flange 14H prevents the pin catch 14D from pulling through the hole 14J. The pin catch 14D extends downward through the hole 14J and receives the ball-detent pin 11E or the stabilizer ball-detent pin 15E depending on the clamp 13, 14. In one embodiment, the pin catch 14D is identical on both clamps. In other embodiments, the pin catch 14D for each clamp 13, 14 has different threading or is even a different type of fastener altogether from the other clamp. In other embodiments, a different fastener such as an embedded nut, embedded nut, sleeve, or other fastener can be used to mate with the particular type of fastener replacing the ball-detent pin 15E.

FIG. 23 shows an exploded view of one embodiment of the device and an instrument to which it attaches.

FIG. 24 shows a side view of one embodiment of the device having threaded holes along the face of the support arm rather than the Velcro® or other adhesive fastener shown in FIG. 16. As described elsewhere, the type of fastener is highly variable as long as it will prevent the instrument from rotating. In the embodiment shown in FIG. 14, the stabilizer 12 has an optional head 12H that can be made or lined in rubber to prevent vibration against the support arm 10 should the fastener become loose. In one embodiment, the stabilizer 12 has a hole for a machine screw 12I to pass through it. In one embodiment, the number of holes and locations of the holes in stabilizer 12 varies. In the embodiment shown in FIG. 24, the support arm has threaded holes 10F to connect with the machine screw 12I. In one embodiment, the number of threaded holes varies. In one embodiment, the location of the threaded holes varies. In one embodiment, the distance between the threaded holes varies. Any fastener will work, provided that it is strong enough to prevent the support arm 10 from rotating under the weight of the instrument.

In one embodiment, not shown, the support arm has a compartment for holding rosin in a convenient location while a user is playing the instrument using the harness of the present disclosure. In one embodiment, the support arm has a slot formed in the top of the support arm to hold a block of rosin underneath the instrument. In one embodiment, a small holder or box is detachably connected to the support arm by Velcro®, machine screw, or some other fastener. In such an embodiment, the holder can be placed along the support arm in a position that is easy to access while the user is playing the instrument but also out of the user's way so that it does not interfere with the user's playing. In one embodiment, the support arm includes a clip or a clamp to hold rosin and hold it in place while the harness is being used. In another embodiment, the box, holder, clip, clamp or other storage device can be used to hold other small items while the user is playing the instrument using the harness.

With the embodiment of the device shown in FIGS. 10 to 23, a person would use the device by attaching the clamps to the stringed instrument, i.e., one clamp on each side of the lower c-bout of the instrument. The person would then attach the neck strap onto the device and place the neck strap around his or her neck. The person would then position the device so that the device's support arm is positioned with the clamp end sitting on the person's shoulder (e.g., on the person's left shoulder) and the non-clamp end extending downward onto the person's chest. The person would fasten the stabilizer to the non-clamp end of the support arm and adjust the position of the support arm so that the instrument is positioned correctly to the person's preferences. At that point, the person would confirm that all attachment points are firmly connected. When using the device, the person can stand or sit with his or her neck straight and without clamping the instrument with his or her chin. The device will hold the weight of the instrument in position while the person plays the instrument, and no other adjustments to the person's playing technique are required.

Summarized slightly differently, the steps of using one embodiment of the harness comprise using the harness described herein to transfer the weight of the instrument through a clamp 13 into the support arm 10 via a pin 11E or other fastener. In one embodiment, the pin or other fastener is attached to the support arm 10 through a second fastener 11G. Once the clamps and fastener(s) are in place, the attitude of support arm 10 becomes fixed, relative to the instrument but the instrument is still prone to rotation around fasteners 11E and 11G. Simultaneous, the rotation of the support arm 10 is fixed in place using stabilizer 12 to stabilize the support arm 10 in rotation about the concentric axes of fasteners 11E and 11G. The stabilizer is attached to the instrument at a different location by a clamp. The rotation of the support arm 10 is set by connecting a stabilizer 12 at its non-clamp end to the support arm 10 using a fastener. The instrument is supported vertically in place by the support arm 10 and prevented from rotating by the stabilizer 12 under the torque created by the weight of the instrument on the harness. The method of supporting a violin or viola using one embodiment of the device is accomplished by supporting the weight of the instrument vertically in place by placing the support arm against a user's shoulder and counterbalancing the support arm using the neck strap placed around the user's neck; detachably connecting the support arm to the instrument with a clamp; and detachably connecting the stabilizer to the instrument with a clamp; stabilizing the rotation of the instrument using the stabilizer by detachably connecting the support arm to the stabilizer underneath the instrument

MISCELLANEOUS

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing an invention (especially in the context of the following claims) are to be construed to cover both the singular and the plural, unless otherwise indicated herein or clearly contradicted by context. The terms "comprising," "having," "including," and "containing" are to be construed as open-ended terms (i.e., "including, but not limited to,") unless otherwise noted. Recitation of ranges as values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention (i.e., "such as, but not limited to,") unless otherwise claimed. No language in the specification should be construed as indicating any non-claimed element as essential to the practice of the invention.

One embodiments of this invention are described herein. Variations of those one embodiments may become apparent to those having ordinary skill in the art upon reading the foregoing description. The inventors expect that skilled artisans will employ such variations as appropriate, and the inventors intend for the invention to be practiced other than as specifically described herein. Accordingly, this invention includes all modifications and equivalents of the subject matter recited in the claims appended hereto as permitted by applicable law. Moreover, any combination of the above-described elements in all possible variations hereof is encompassed by the invention unless otherwise indicated herein or otherwise clearly contradicted by context.

While the disclosure above sets forth the principles of the present invention, with the examples given for illustration only, one should realize that the use of the present invention includes all usual variations, adaptations and/or modifications, within the scope of the claims attached as well as equivalents thereof. Those skilled in the art will appreciate from the foregoing that various adaptations and modifications of the just described embodiments can be configured without departing from the scope and spirit of the invention. Therefore, it is to be understood that, within the scope of the appended claims, the invention may be practiced other than as specifically described herein.

What is claimed is:

1. A harness for supporting a violin or viola in a playing position comprising:

a first clamp and a second clamp, each fitted with a compressible material for engaging a front and a rear of an instrument having a lower bout, the first clamp for engaging the front and rear at the lower bout on one side of the instrument and the second clamp for engaging the front and rear at the lower bout on another side of the instrument;

a support connected to the first clamp; and a stabilizer connected to the second clamp;

wherein the stabilizer is configured to releasably attach to the support and stabilize the support when the support is connected to the instrument, and the clamps hold the support and the stabilizer to the instrument; and wherein the harness can be fastened to an adjustable neck strap.

2. The harness of claim 1, further wherein the support supports the weight of the instrument and the stabilizer prevents the support and the instrument from rotating when the support is on a user's shoulder.

3. The harness of claim 1 further comprising a pair of attachment points, one extending from each clamp providing attachment points for the neck strap.

4. The harness of claim 1, the first and second clamps configured to connect to the front and rear edge of the lower bout.

5. The harness of claim 1, wherein the support is a cantilevered support arm.

6. The harness of claim 1, the support further configured to support the weight of the instrument and the stabilizer further configured to prevent the rotation of the support under the weight of the instrument.

7. The harness of claim 1, the stabilizer further configured to prevent the rotation of the instrument.

8. The device of claim 1, the support further comprising a holder for storing rosin.

9. A device for supporting a violin or a viola in a playing position comprising:

a first clamp and a second clamp each configured to engage the body of an instrument;

a support arm having a clamp end, and the clamp end is attached to the first clamp;

a stabilizer having a clamp end and a non-clamp end, and the clamp end is attached to the second clamp and the non-clamp end is configured to attach to the support arm;

a neck strap having a first end and a second end, the first end is attached to the first clamp and the second end attached to the second clamp;

wherein, when the clamps are attached to an instrument, the first clamp and the second clamp attach to different locations on the instrument;

further wherein, when the clamps are attached to an instrument, the non-clamp end of the stabilizer attaches to the support arm; and further wherein, when the clamps are attached to an instrument and the neck strap is around a person's neck, the support arm holds the instrument on a person's shoulder.

10. The device of claim 9, the support arm further comprising: a non-clamp end and a curved body, and the curved body allows the clamp end of the support arm to be substantially horizontal to the ground and the non-clamp end of the support arm to be substantially perpendicular to the ground when the device is positioned on a person's shoulder.

11. The device of claim 10, the support arm further comprising:

a twisted section that allows the clamp end of the support arm to sit on a person's shoulder and the non-clamp end of the support arm to sit against a person's chest; wherein when an instrument is attached to the device and the device is positioned on a person's shoulder, the clamp-end presses down into the person's shoulder and the non-clamp end presses back against the person's chest.

12. The device of claim 9, further wherein the stabilizer keeps the instrument from rotating.

13. The device of claim 9, further wherein when the neck strap is around a person's neck, and the clamps are attached to an instrument, the weight of the instrument presses the support arm against the person's shoulder and the resulting tension in the neck strap holds the instrument in place.

14. The device of claim 9, the support arm further comprising a padded underside.

15. The device of claim 9, the clamp end of the support arm being detachably connected to the first clamp.

16. The device of claim 9, the stabilizer being a coated bendable wire.

17. The method of supporting a violin or viola using the device of claim 1 comprising: supporting the weight of the instrument vertically in place by placing the support arm against a user's shoulder; counterbalancing the support arm using the neck strap placed around the user's neck; detachably connecting the support arm to the instrument with a clamp; detachably connecting the stabilizer to the instrument with a clamp; and stabilizing the rotation of the instrument using the stabilizer by detachably connecting the support arm to the stabilizer underneath the instrument.

* * * * *